US006152713A

United States Patent [19]

Hisanaga et al.

[11] Patent Number: 6,152,713

[45] Date of Patent: Nov. 28, 2000

[54] SCROLL TYPE COMPRESSOR

[75] Inventors: Shigeru Hisanaga, Kariya; Tsuyoshi Takemoto, Nukata-gun; Yoshitaka Akiyama, Chiryu; Shinichi Watanabe, Chitta-gun; Hiroyuki Hayashi, Kariya; Yasushi Watanabe, Kariya; Tatsushi Mori, Kariya; Izuru Shimizu, Kariya; Masao Iguchi, Kariya, all of Japan

[73] Assignees: Denso Corporation; Kabushiki Kaisha Toyoda Jidoshokki Seisakusho, both of Kariya, Japan

[21] Appl. No.: 09/141,955

[22] Filed: Aug. 28, 1998

[30] Foreign Application Priority Data

| | | | |
|---|---|---|---|
| Aug. 29, 1997 | [JP] | Japan | 9-249603 |
| Sep. 1, 1997 | [JP] | Japan | 9-236255 |
| Sep. 5, 1997 | [JP] | Japan | 9-241472 |

[51] Int. Cl.[7] ..... F01C 1/02

[52] U.S. Cl. ..... 418/55.2; 418/14; 418/55

[58] Field of Search ..... 418/55, 55.6, DIG. 1, 418/15, 55.1, 55.2, 97, 141, 55.4, 14, 55.3; 55/505, 330, 337, 323

[56] References Cited

U.S. PATENT DOCUMENTS

| | | | |
|---|---|---|---|
| 4,260,402 | 4/1981 | Shaffer et al. | 55/505 |
| 4,470,778 | 9/1984 | Mabe | 48/55 |
| 4,861,245 | 8/1989 | Tojo et al. . | |
| 5,421,709 | 6/1995 | Hill et al. | 418/55.6 |
| 5,501,584 | 3/1996 | Yamamoto et al. | 418/15 |
| 5,536,153 | 7/1996 | Edwards | 418/97 |
| 5,560,741 | 10/1996 | Edwards | 418/141 |
| 5,567,137 | 10/1996 | Nakashima et al. . | |
| 5,584,677 | 12/1996 | Ishikawa et al. . | |
| 5,584,678 | 12/1996 | Hirooka et al. | 418/55.2 |
| 5,678,986 | 10/1997 | Terauchi et al. | 418/55.6 |
| 5,681,155 | 10/1997 | Hisanaga et al. | 418/14 |
| 5,716,202 | 2/1998 | Koyama et al. | 418/55.6 |
| 5,759,021 | 6/1998 | Yamaguchi et al. | 418/55.3 |
| 5,888,057 | 3/1999 | Kitano et al. | 418/55.2 |

FOREIGN PATENT DOCUMENTS

| | | |
|---|---|---|
| 0 052 234 | 5/1982 | European Pat. Off. . |
| 0 502 514 | 9/1992 | European Pat. Off. . |
| 0 520 431 | 12/1992 | European Pat. Off. . |
| 0 664 396 | 7/1995 | European Pat. Off. . |

*Primary Examiner*—Teresa Walberg
*Assistant Examiner*—Leonid Fastovsky
*Attorney, Agent, or Firm*—Pillsbury Madison & Sutro LLP

[57] ABSTRACT

A scroll type compressor having a front housing, a rear housing, an intermediate outer shell portion arranged between the front and rear housing to form an integral stationary scroll element having a stationary end plate and a stationary spiral member, a movable scroll element having a movable end plate and a movable spiral element and being engaged with the stationary scroll element to define a plurality of compression chambers shifting and reducing in volume to compress refrigerant gas, containing therein an oil component, in response to an orbiting motion of the movable scroll element, a suction port formed in the intermediate outer shell portion to directly introduce the refrigerant gas into the compression chambers, and a discharge chamber in which the refrigerant gas after compression is discharged from the compression chambers. The rear housing having an oil-separating chamber for separating the oil component from the refrigerant gas after compression and an oil-storing chamber for storing therein the separated oil to be supplied to the interior of the front housing via an oil passage formed in the intermediate outer shell to cool and lubricate movable elements and portions of the compressor.

15 Claims, 20 Drawing Sheets

SCROLL TYPE COMPRESSOR

BACKGROUND OF THE INVENTION

1. Field of the Invention

The present invention relates to a scroll type compressor and particularly relates to a scroll type compressor suitable for being non-exclusively incorporated in a refrigerating system of a vehicle to be driven by a vehicle engine.

2. Description of the Related Art

Generally, a conventional scroll type compressor includes a housing to which a stationary scroll element is attached so that a movable scroll element, accommodated in the housing, implements orbiting motion with respect to the stationary scroll element. The stationary scroll element includes a stationary end plate and a stationary spiral member, and the movable scroll element includes a movable end plate and a movable spiral member. The stationary and movable scroll elements are engaged with one another to form compression chambers therebetween, and the compression chambers are shifted from an outer end of the stationary scroll member toward a center thereof so as to reduce the respective volumes thereof during the orbiting motion of the movable scroll element with respect to the stationary scroll element. Thus, a fluid to be compressed, such as refrigerant gas, is compressed in the volume-reduced compression chambers. The refrigerant gas delivered from the scroll type compressor is circulated through the refrigerating system to return to the compressor.

In the conventional scroll type compressor as disclosed in Japanese Unexamined Patent Publication (Kokai) No. 3-100389, the stationary scroll element is housed in a casing forming a part of the housing, and front and rear housings are attached to front and rear ends of the casing, respectively. Namely, the stationary scroll element is formed as an element separate from the casing, and has a stationary spiral element formed as a spirally extending projection projecting from an end face of a stationary end plate. Therefore, a gap necessarily appears between the stationary spiral element and the casing to form a suction chamber having a large volume. The compressor is further provided with a suction port formed in the casing and arranged to communicate with the suction chamber. Thus, the refrigerant gas returning from the refrigerating system is introduced into the suction chamber via the suction port, and a large part of the refrigerant gas is sucked into the compression chambers to be compressed therein while the respective compression chambers are shifted. However, some part of the refrigerant gas is conducted into the front housing to cool and lubricate a bearing device rotatably supporting the movable scroll element and a self-rotation preventing unit for preventing a movable scroll element from implementing a self-rotation during its orbiting motion which are housed in the front housing. A further part of the refrigerant gas is conducted to a slidably engaging portion of the movable and stationary elements to cool and lubricate the engaging portion. The lubrication is achieved by a lubricating oil mist mixed with the refrigerant gas. The refrigerant gas after cooling and lubricating the above-mentioned device, unit and portion is eventually sucked into the compression chambers to be compressed therein.

Japanese Unexamined Patent Publication (Kokai) No. 7-133768 discloses a scroll type compressor of the type wherein a stationary scroll element has a shell portion thereof forming a part of an outer shell of the compressor. Thus, the shell portion is provided with a stationary end plate and a stationary spiral member which is obtained by forming a spiral groove in the shell portion. The scroll type compressor of JP-A-7133768 has a front housing attached to a front end of the shell portion, and the front housing is provided with a suction port formed therein to introduce refrigerant gas into the interior of the front housing. Therefore, the refrigerant gas in the interior of the front housing may be used for cooling and lubricating a bearing device for rotatably supporting a movable scroll element before it is sucked into compression chambers formed between the movable and stationary scroll elements to be compressed therein.

Nevertheless, in the above-described conventional scroll type compressors of JP-A-3100389 and JP-A-7133768, the suction chamber permits the refrigerant gas to be expanded therein, and the bearing device, the self-rotation preventing unit and other portions cooled and lubricated by the refrigerant apply heat to the refrigerant gas before the refrigerant gas is sucked into the compression chambers. Therefore, the scroll type compressors cause a pressure loss of the refrigerant gas due to the expansion thereof, and accordingly, produce an increase in the specific volume of the refrigerant gas before the gas is sucked into the compression chambers. Thus, the conventional scroll type compressors cannot meet a recent requirement for an enhancement of the compression performance.

If the refrigerant gas containing therein lubricating oil mist for lubricating the bearing device and other movable portions of the compressor is directly compressed and delivered into the refrigerating system, a defect occurs in which the refrigerating performance of the refrigerating system must be lowered due to existence of the oil component in the refrigerant. Thus, in order to overcome such defect, Japanese Unexamined Patent Publication (Kokai) No. 3-129273 discloses a scroll type compressor of the type wherein an oil-separating chamber for separating a lubricating oil component from the refrigerant gas after being compressed, and a oil-storing chamber for storing the separated oil therein are arranged in the housing. The oil-storing chamber is arranged to receive the oil separated from the refrigerant gas in the oil-separating chamber. The oil-storing chamber fluidly communicates with movable portions of the compressor such as a bearing device for rotatably supporting a movable scroll element, a self-rotation preventing unit for preventing the movable scroll element from implementing a self-rotation during its orbiting motion, and an engaging portion of the stationary and movable scroll elements via oil-supply passages. Thus, lubricating oil can be supplied for lubricating the bearing device, the self-rotation preventing unit, and the engaging portion of stationary and movable scroll elements. Further, since refrigerating gas from which the oil component is separated is delivered to the refrigerating system, the afore-mentioned defective reduction in the refrigerating performance of the refrigerating system does not occur.

Nevertheless, the oil-supply passage which provides a fluid communication between the oil-storing chamber and the engaging portion of stationary and movable scroll elements must usually be very small, and accordingly, the oil-supply passage might be plugged by metallic powder, produced by abrasion of the stationary and movable scroll elements, having a smallest diameter of at most 50 micrometers. The abraded metallic powder adheres to a portion around an entrance of the oil-supply passage which opens toward the stationary spiral member of the stationary scroll element, and prevents the lubricating oil from being supplied to the engaging portion of the movable and stationary scroll elements or reduces the amount of the lubricating oil supplied to the engaging portion. Accordingly, a lack of lubrication occurs in the engaging portion of the movable and stationary scroll elements. Further, the metallic abrasion powder adhering to the portion around the entrance of the oil-supply passage might prevent the movable scroll element from implementing a smooth orbiting motion thereof, and accordingly, a reliable operation of the scroll type compressor cannot be ensured. Particularly, when the operation of the scroll type compressor is started after a long stopped condition at a high temperature, the liquid-phase refrigerant is initially sucked into the compression chambers so as to cause liquid compression. As a result, the movable scroll element collides against the stationary scroll element during the orbiting motion of the movable scroll element, and accordingly, production of the abraded metallic powder is unfavorably increased to easily cause the above-mentioned problem.

SUMMARY OF THE INVENTION

A principal object of the present invention is to provide a scroll type compressor by which the above-mentioned problems encountered by the conventional scroll type compressors can be solved and which is capable of exhibiting a high compressing performance due to an ability of preventing the compressor from being over-heated, and of reducing the specific volume of the refrigerant gas being compressed.

Another object of the present invention is to provide a scroll type compressor provided with self-cooling and self-lubricating abilities by which an incorporated bearing device and other movable portions thereof are cooled and lubricated to facilitate smooth and reliable operation of the compressor over a long operating life.

A further object of the present invention is to provide a scroll type compressor capable of delivering compressed refrigerant gas from which an oil component for cooling and lubrication has been separated and removed in advance, so that an external refrigerating system incorporating therein the scroll type compressor can exhibit an increased refrigerating performance.

A still further object of the present invention is to provide a scroll type compressor, using an oil-contained refrigerant, accommodating therein an internal oil-processing means for separating an oil component from refrigerant gas before the delivery of the refrigerant from the compressor and constantly supplying the separated oil component into all movable elements and portions within the compressor for cooling and lubrication.

In accordance with the present invention, there is provided a scroll type compressor which comprises:

a housing assembly including a front housing, an intermediate outer shell portion, and a rear housing;

a stationary scroll element having a stationary end plate fixedly held by the housing assembly and a stationary spiral member integral with the stationary end plate;

a movable scroll element movably supported in the housing assembly by a bearing device held by the front housing and having a movable end plate, and a movable spiral member integral with the movable plate end, the movable scroll element being arranged to be engaged with the stationary scroll element to form, between both elements, compression chambers for compressing a refrigerant gas, the compression chambers being spirally shifted, to reduce the volumes thereof, in response to an orbiting motion of the movable scroll element with respect to the stationary scroll element, the compressed refrigerant being delivered from the compression chambers to an external refrigerating system via a discharge chamber formed in the rear housing; and, a drive shaft arranged to be rotatable about an axis of rotation thereof within the front housing of the housing assembly and to generate the orbiting motion of the movable scroll element with respect to the stationary scroll element, wherein the stationary end plate and the spiral member of the stationary scroll element are formed integrally with the intermediate outer shell portion of the housing assembly, the stationary scroll element defining a spiral groove formed in the intermediate outer shell portion to spirally extend from an outer end thereof toward an inner end thereof, the intermediate outer shell portion having a suction port formed therein to communicate with the outer end of the spiral groove to thereby permit the refrigerant gas to be introduced into each of the compression chambers before each of the compression chambers is spirally shifted.

The above-described scroll type compressor includes the intermediate outer shell portion formed integrally with the stationary end plate and the stationary spiral member, and is not provided with any conventional suction chamber formed as an internal cavity, except for a small recessed allowance used for retracting the intermediate shell portion from a molding die during the production thereof by a die casting method. Thus, the refrigerant gas introduced into the each of the compression chambers of the scroll type compressor via the suction port of the intermediate outer shell portion is not subjected to volumetric expansion within the interior of the compressor. Therefore, there does not occur any appreciable pressure loss of the refrigerant gas when the refrigerant gas is introduced into the compressor for compression, and accordingly, a reduction in the specific volume of the refrigerant gas can be obtained by compressing the refrigerant gas in the compression chambers.

Further, when the refrigerant gas returns from the external refrigerating system, the refrigerant gas is directly introduced into the compressor and sucked into each of the compression chambers via only the suction port formed in the intermediate outer shell portion. Thus, the introduced refrigerant gas can be prevented from being heated by heat produced by movable elements and portions of the compressor such as a bearing device movably supporting the movable scroll element and engaging portions of the stationary and movable scroll elements. Therefore, overheating of the refrigerant gas does not occur. Accordingly, a loss of pressure of the refrigerant gas can be further prevented, and a reduction in the specific volume of the refrigerant gas can be obtained by compressing the refrigerant gas. Therefore, the above-described scroll type compressor according to the present invention can satisfy an increasing requirement for a good and reliable compressing performance.

Nevertheless, in the above-identified scroll type compressor, since the refrigerant gas coming from the external refrigerating system is directly introduced into the compression chambers via the suction port, the refrigerant gas is not conducted into a front housing of the housing assembly which is attached to the front end of the shell portion. Thus, the introduced refrigerant gas passing through the suction port is unable to cool and lubricate movable elements and portions such as a bearing device, for movably supporting the movable scroll element, and a self-rotation preventing unit for preventing the movable scroll from implementing a self-rotation during its orbiting motion.

Further, the introduced refrigerant gas is also unable to cool and lubricate an engaging portion of the stationary and movable scroll elements.

In order to appropriately cool and lubricate the above-mentioned movable elements and portions, the scroll type compressor in accordance with the present invention is further characterized in that the rear housing is provided with an oil-separating chamber for separating an oil component contained in the compressed refrigerant gas therefrom when the compressed gas enters from the discharge chamber into the oil-separating chamber via an entrance passage, and an oil-storing chamber fluidly communicating with the oil-separating chamber, and storing the separated oil component, the oil-storing chamber communicating with an interior of the front housing via a fluid passage formed in the housing assembly. The fluid passage preferably includes a linear passage extending through the intermediate outer shell portion and having open ends formed in front and rear opposite ends of the shell portion. Thus, the interior of the front housing is constantly supplied with the oil component from the oil-separating chamber of the rear housing via the oil passage. The bearing device and other movable elements and portions housed by the front housing, and an engaging portion of the stationary and movable scroll elements can be cooled and lubricated by the oil component supplied into the front housing via the oil passage. Namely, the refrigerant gas is not used for cooling and lubricating the bearing device and the other movable elements and portions housed in the front housing, and the compressed refrigerant gas from which the oil component has been separated is delivered to the external refrigerating system. Accordingly, the compressing performance of the scroll type compressor and the refrigerating performance of the external refrigerating system can be kept at a high level.

Preferably, the suction port of the intermediate outer shell portion is bored and arranged at a position adjacent to the outer end of the spiral groove of the stationary scroll element to permit the refrigerant gas to be directly introduced into the compression chambers. Thus, the suction port can be geometrically short enough to permit the suction port to have a small volume thereof. Thus, all of the refrigerant gas introduced through the suction port is immediately supplied into the compression chambers to be compressed. That is, no appreciable part of the introduced gas stays in the suction port before being supplied into the compression chambers. Therefore, the compression efficiency of the scroll type compressor can be kept high. Further, when the diameter of the suction port is adjustably and intentionally reduced or increases at the manufacturing stage of the compressor, the suction port can adjust an amount of flow of the refrigerant gas passing therethrough, so that suction efficiency of the refrigerant gas introduced into the compressor may be adjusted. Accordingly, it is possible for the scroll type compressor of the present invention to exhibit a balanced compression performance suitable for both low and high rotational speed ranges. Namely, the scroll type compressor can exhibit an increased compression performance in a low rotational speed range and a reduced compression performance in a high rotational speed range. Therefore, the scroll type compressor of the present invention permits a vehicle refrigerating system, in which the compressor is incorporated to be driven by a vehicle engine, to exhibit a high refrigerating performance, on average, over the low through high rotational speed range of the vehicle. Further, a reduction in the drive power for driving the compressor can be achieved.

Preferably, the scroll type compressor is further provided with a filtering element for removing impurities contained in the oil component before the oil component is supplied into the interior of the front housing.

Preferably, the filtering element is held by at least two of the intermediate outer shell portion, the rear housing, and a gasket element arranged between the stationary scroll element integral with the intermediate outer shell portion and the rear housing.

Preferably, the filtering element is arranged between the oil-storing chamber and the fluid passage, so that the impurities are removed from the oil component by the filtering element before the oil component enters the fluid passage.

Alternatively, the filtering element may be arranged between the oil-separating chamber and the oil-storing chamber, so that the impurities are removed from the oil component by the filtering element before the oil component flows from the oil-separating chamber into the oil-storing chamber. When the oil-separating chamber and the oil-storing chamber is fluidly connected by an oil outlet passage, the filtering element may be arranged in the oil outlet passage.

Preferably, the oil outlet passage arranged between the oil-separating chamber and the oil-storing chamber is formed to have a central axis thereof along which the oil component flows from the oil-separating chamber into the oil-storing chamber, which extends in parallel with an upper level of the oil component stored within the oil-storing chamber.

Further, when the oil-separating chamber is defined by a substantially columnar inner wall to have a substantially cylindrical cavity therein, the entrance passage between the discharge chamber and the oil-separating chamber preferably has a central axis thereof extending tangentially to the columnar inner wall of the oil-separating chamber, and the central axis of the oil outlet passage preferably extends to be tangential to the columnar inner wall of the oil-separating chamber.

Preferably, the entrance passage lies in a plane corresponding to, or located above, a reference plane which extends parallel to the upper level of the oil component and permits the oil outlet passage to lie therein. Further, the oil-separating chamber in the shape of the columnar cavity has a central axis $L_1$ thereof which is inclined with respect to a reference line $L_0$ vertical to the upper level of the oil component within the oil-storing chamber.

Preferably, the entrance passage and the oil outlet passage are arranged to be in juxtaposition and parallel to one another.

Preferably, in use, the scroll type compressor is arranged so that the axis of rotation of the drive shaft extends in parallel with the upper level of the oil component stored in the oil-storing chamber.

The scroll type compressor of the present invention may be provided with a buffer wall member for preventing the oil component discharging from the oil-separating chamber toward the oil-storing chamber through the oil outlet passage from directly colliding against the upper level of the oil component stored in the oil-storing chamber.

BRIEF DESCRIPTION OF THE DRAWINGS

The above and other objects, features, and advantages of the present invention will be made more apparent from the ensuing description of preferred embodiments with reference to the accompanying drawings wherein.

DESCRIPTION OF THE PREFERRED EMBODIMENTS

Figure 1:
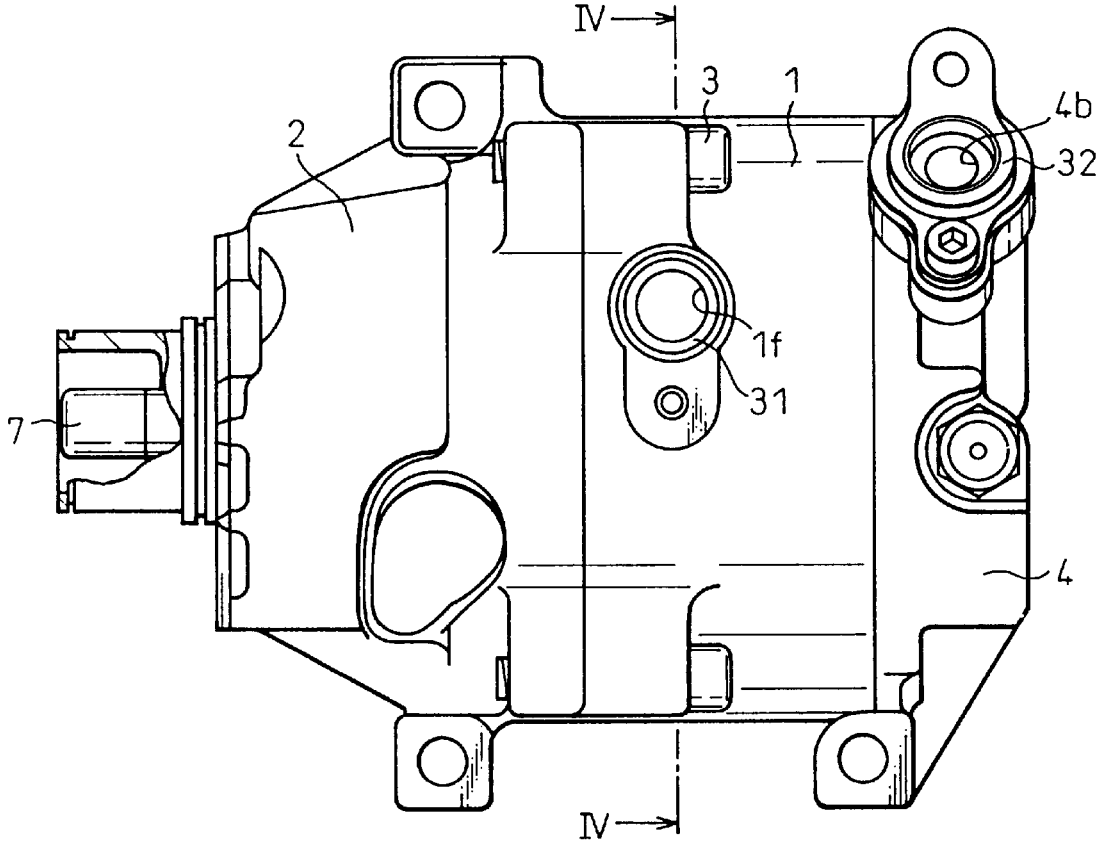
FIG. 1 is a side elevation of a scroll type compressor according to a first embodiment of the present invention.

Throughout the description of the first through eighth embodiments and several modifications of the present invention illustrated in FIGS. 1 through 24, the same reference numerals designate like or identical elements and parts.

Figure 2:
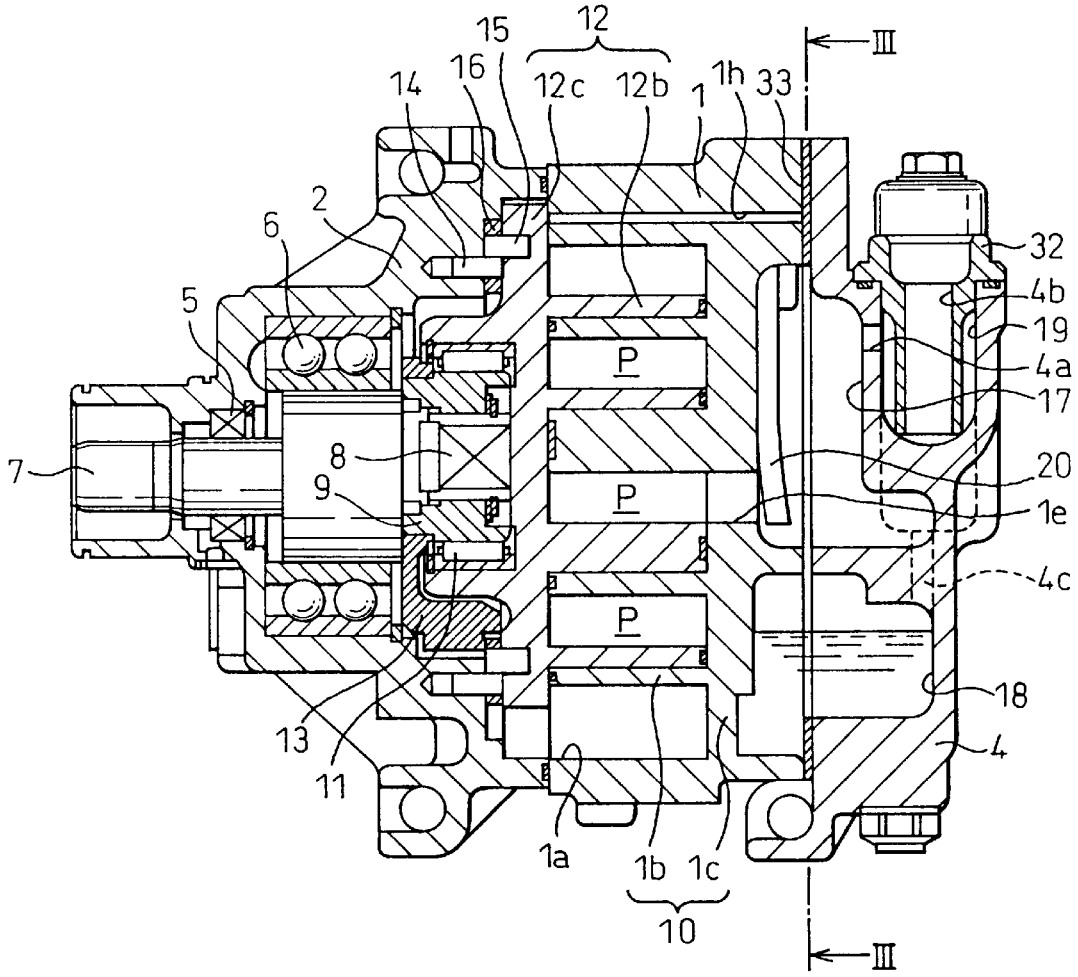
FIG. 2 is a longitudinal cross-sectional view of the scroll type compressor of the first embodiment of the present invention.

Referring to FIGS. 1 through 7, particularly to FIGS. 1 and 2, the scroll type compressor of the first embodiment of the present invention includes an intermediate shell portion 1 having a front end to which a front housing 2 is fixed, via an O-ring, by a plurality of screw bolts 3, and a rear end to which a rear housing 4 is fixed, via a gasket member 33, by a plurality of screw bolts (not shown).

The intermediate shell portion 1 forms a middle part of an outer shell of the compressor, and is internally provided with a spiral groove 1*a* recessed therein to spirally extend from an outer end to an inner end. Thus, the shell portion 1 has a stationary spiral member 1*b* in the shape of a spiral wall enclosing the spiral groove 1*a,* and a stationary end plate 1*c* from which the spiral member 1*b* projects toward the front housing 2. The stationary spiral member 1*b* and the stationary end plate 1*c* constitutes a stationary scroll element 10.

As best shown in FIGS. 4 through 7, the intermediate shell portion 1 is provided with a suction port *if* bored therein at a position adjacent to an outer end of the spiral groove 1*a* so that the suction port *if* is connectable to an evaporator (not shown) of an external refrigerating system via a suction service valve 31, and a suitable conduit means (not shown). Typically, when the scroll type compressor is incorporated in a vehicle refrigerating system, the delivery capacity of the compressor is nominally designed to be 80 cc/rev., and the inner diameter of the suction port 1*f* is set to be 9 through 10 mm. Since the intermediate shell portion 1 is produced by a conventional die-casting method, the intermediate shell portion 1 is provided with a groove-like allowance 1*d,* formed at a position adjacent to the outer end of the spiral groove 1*a,* which permits a core (not shown) to be eventually extracted from the shell portion 1 at the final stage of the die-casting process.

As shown in FIG. 2, the front housing 2 houses therein a drive shaft 7 rotatable about an axis of rotation thereof within the front housing 2. The drive shaft 7 is supported by a shaft sealing device 5 and a bearing device 6, and has an inner end in which a slide key 8 is integrally formed so as to rearwardly project and to have an eccentric relation with respect to the axis of rotation of the drive shaft 7. A drive bushing 9 is mounted on the slide key 8 to be radially minutely shiftable. The drive bushing 9 is engaged with the movable scroll element 12 via a bearing device 11, and has a counter-weight 13 fixed thereto. The movable scroll element 12 includes a movable end plate 12*c* mounted on the bearing device 11 and a movable spiral member 12*b* in the shape of a projection spirally extending from an inner end to an outer end on the rear end face of the movable end plate 12*c*. The movable scroll element 12 having the movable end plate 12*c* and the movable spiral element 12*b* is engaged with the stationary scroll element 10 having the stationary end plate 1*c* and the stationary spiral member 1*b* so as to form a plurality of compression chambers P therebetween.

The front housing 2 is provided with a plurality of pins 14 fixed thereto, and the movable end plate 12*c* of the movable scroll element 12 is provided with a plurality of pins 15 fixed thereto. The pins 14 and 15 are engaged in a plurality of retainer members 16 slidably fitted in seats recessed in an inner end face of the front housing 2, and form a self-rotation preventing unit for preventing the movable scroll element 12 from rotating about its own axis. Plate-like shims (not shown) are arranged between the front end face of the movable end plate 12*c* and the respective retainer members 16 so as to adjust gaps therebetween and to permit a smooth motion of the movable scroll element 12 and the retainer members 16.

The stationary end plate 1*c* of the stationary scroll element 10 is provided with a discharge port 1*e* formed at a substantially central position of the stationary end plate 1*c*. The discharge port 1*e* of the stationary end plate 1*c* is opened and closed by a discharge valve (not shown). An amount of opening of the discharge valve is limited by a curved retainer member 20 fixed to the stationary end plate 1*c*.

Figure 3:
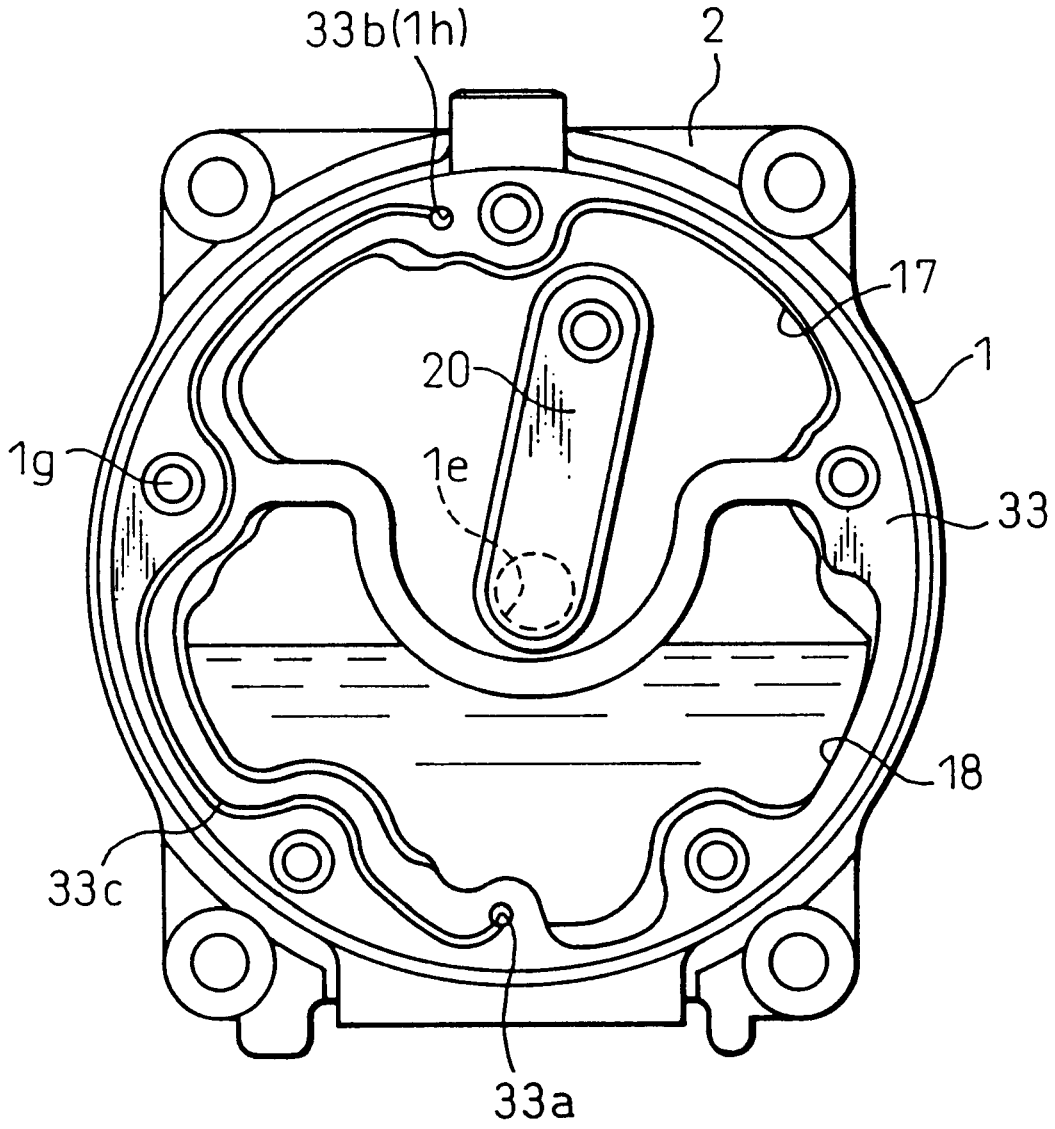
FIG. 3 is an end view taken along the line III—III of FIG. 2, illustrating an arrangement of a fluid passage for an oil component provided between an outer shell portion and a rear housing.
Figure 4:
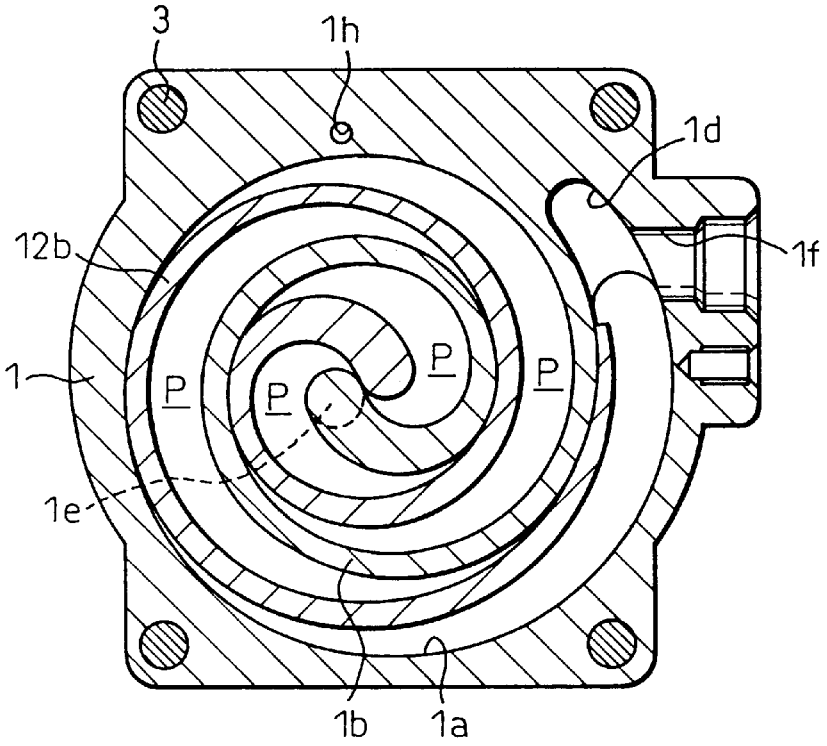
FIG. 4 is a cross-sectional view taken along the line IV—IV of FIG. 1, illustrating compression chambers formed by stationary and movable scroll elements of the scroll type compressor of the first embodiment.
Figure 5:
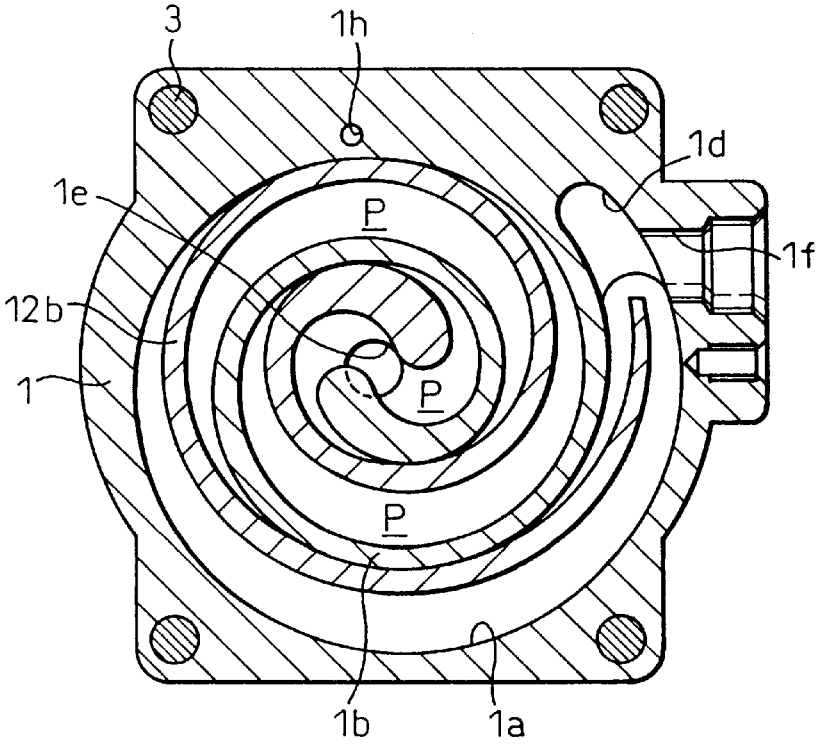
FIG. 5 is the same cross-sectional view as FIG. 4, illustrating a condition where the movable scroll element is rotated through 90° from a condition shown in FIG. 4.
Figure 6:
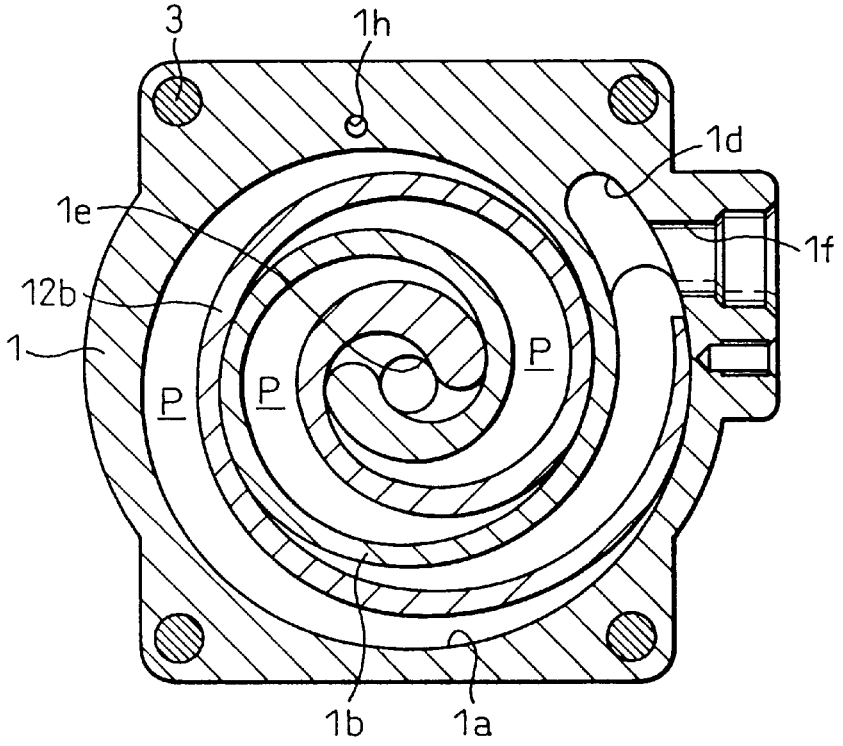
FIG. 6 is the same cross-sectional view as FIG. 4, illustrating a condition where the movable scroll element is rotated through 180° from the condition shown in FIG. 4.
Figure 7:
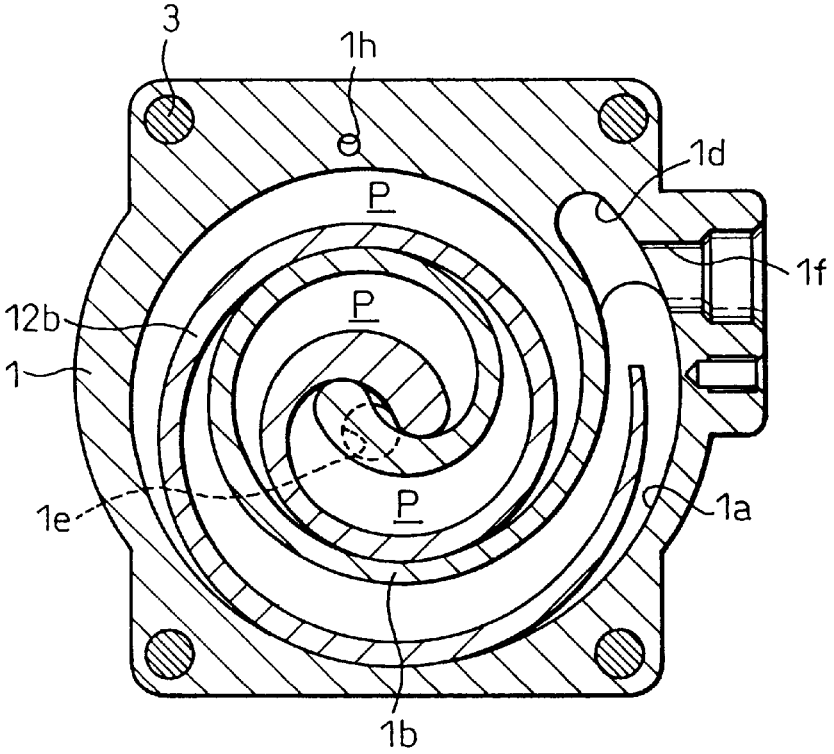
FIG. 7 is the same cross-sectional view as FIG. 4, illustrating a condition where the movable scroll element is rotated through 270° from the condition shown in FIG. 4.

The intermediate shell portion 1 and the rear housing 4 cooperate to define a discharge chamber 17 and an oil-storing chamber 18 (FIGS. 2 and 3). The rear housing 4 further defines therein an oil-separating chamber 19 as shown in FIG. 2.

The discharge chamber 17 is able to communicate with each of the compression chambers P, via the discharge port 1*e*, when each compression chamber p is shifted from an outermost position thereof to an innermost position thereof where the compression of refrigerant gas is completed. The discharge chamber 17 communicates with the oil-separating chamber 19 via an entrance passage 4*a* through which the compressed refrigerant gas containing therein an oil component moves from the chamber 17 into the oil-separating chamber 19 in which a delivery service valve 32 having a delivery port 4*b* is arranged. Thus, the entrance passage 4*a*, the oil-separating chamber 19 and the delivery service valve 32 constitute a built-in type oil-processing unit housed in the compressor and implementing oil separation using a centrifugal oil-separating principle. The delivery service valve 32 can be suitably connected to a condenser of the external refrigerating system.

The oil-separating chamber 19 has a bottom wall in which an oil outlet passage 4*c* in the shape of a through-bore is formed so as to provide a fluid communication between the oil-separating chamber 19 and the oil-storing chamber 18.

The gasket 33 is provided with an oil-supply port 33*a* (FIG. 3) formed in a lower portion thereof so as to fluidly communicate with a part of the oil-storing chamber 18 which is arranged in the intermediate shell portion 1. The gasket 33 is also provided with an oil-supply port 33*b* formed in an upper portion thereof. The two oil-supply ports 33*a* and 33*b* are connected to one another by an oil supply passage 33*c* recessed in an end face of the gasket 33 which faces an inner end of the rear housing 4. As shown in FIGS. 2 and 4 through 7, the oil-supply port 33*b* communicates with an oil-supply passage 1*h* linearly axially extending through the intermediate shell portion 1 and having an open front end opening into a slidably engaging portion of the stationary spiral member 1*b* and the movable end plate 12*c*. Namely, the oil-supply ports 33*a* and 33*b*, the oil supply passage 33*c*, and the oil-supply passage 1*h* constitute an oil-supply passageway means for supplying an oil component stored in the oil-storing chamber 18 into the interior of the engaging portion of the stationary and movable scroll elements 10 and 12 as described later. As shown in FIG. 3, the rear end face of the intermediate shell portion 1 is provided with a plurality of projecting pins 1*g* projecting rearwardly through the gasket 33.

In the scroll type compressor of the first embodiment of FIGS. 1 through 7, the drive shaft 7 is rotationally driven by a vehicle engine via a pulley and belt mechanism and a solenoid clutch (not shown). Thus, the slide key 8 is rotated together with the drive shaft 7 so as to drive the drive bushing 9. Therefore, the drive bushing 9 cooperates with the self-rotation preventing unit 7 to drive the orbiting motion of the movable scroll element 12 along a predetermined orbiting path. Accordingly, each of the plurality of compression chambers P is shifted from a spirally outer position toward a spirally inner position while gradually reducing the volume thereof.

As shown in FIGS. 4 through 7, when the movable spiral member 12*b* of the movable scroll element 12 forms a pair of compression chambers P at the outer end of the spiral groove 1*a*, the refrigerant gas having come from the external evaporator is equally sucked into the respective compression chambers P after passing through the suction port 1*f*. Only a part of the sucked refrigerant gas flows toward the bearing device 6 and the self-rotation preventing unit for a very short time before the pair of compression chambers P are closed by the movable end plate 12*c* of the movable scroll element 12, and the refrigerant gas cools the device 6 and the self-rotation preventing unit. Namely, in the described scroll type compressor of the first embodiment, no appreciable volume of suction chamber, except for the fore-mentioned groove-like allowance 1*d*, is formed and, accordingly, the refrigerant gas sucked into the compression chambers P via the suction port 1*f* is immediately subjected to compressing action by the stationary and movable scroll elements without causing an expansion of the gas in the interior of the compressor. Therefore, a loss of pressure of the refrigerant gas does not occur to reduce the specific volume of the refrigerant gas.

Further, since the refrigerant gas from the evaporator of the external refrigerating system is immediately sucked into the compression chambers P via the suction port 1*f*, the refrigerant gas is not subjected to heating by the bearing devices 6 and 11 before it is compressed. Thus, no excessive heating of the refrigerant gas occurs within the compressor. This fact further contributes to preventing the refrigerant gas from losing pressure within the compressor, and reduces the specific volume of the refrigerant gas. Therefore, the scroll type compressor of the first embodiment of the present invention can surely comply with a recent requirement for an increase in the compressing performance thereof.

Further, in the described scroll type compressor of the first embodiment, the suction port 1*f* is bored in the intermediate shell portion 1 at a position adjacent to the outer end of the spiral groove 1*a* and is a very short path. Thus, the suction port 1*f* can be a very small cavity to prevent the refrigerant gas from staying therein for any appreciable time, and accordingly, the compressing performance of the compressor is not reduced.

Furthermore, it is possible to adjustably change the inner diameter of the suction port 1*f* at the stage of producing the intermediate shell portion 1. Therefore, for example, when the suction port 1*f* is adjusted to have a reduced inner diameter in comparison with the conventional scroll type compressor, the diameter-reduced suction port 1*f* can function as a throttling bore to reduce the amount of the refrigerant gas sucked into the compression chambers P. Accordingly, the suction efficiency of the refrigerant gas can be adjustably changed by adjustably reducing the inner diameter of the suction port 1*f*. As a result, the scroll type compressor of the first embodiment can satisfy both an increase in the compressing performance thereof in a low speed range where the vehicle engine speed is from idling to approximately 1,500 R.P.M. occurring in a traffic-jam mode and a cool-down mode of the vehicle engine, and a suppression of the compressing performance thereof at a high speed range of the vehicle engine. Thus, the compressing performance of the scroll type compressor can be enhanced, on average, while achieving a curtailment of a drive power required for driving the compressor.

The refrigerant gas compressed in the respective compression chambers P during the shifting of the chambers P toward the center of the spiral curve of the stationary and movable scroll elements 10 and 12, is discharged into the discharge chamber 17 via the discharge port 1*e,* and the discharge valve. The refrigerant gas in the discharge chamber 17 subsequently enters the oil-separating chamber 19 via the entrance passage 4*a* and runs around the cylinder portion of the delivery service valve 32 so as to separate an oil mist component from the refrigerant gas by centrifugal force. The separated oil component is delivered into the oil-storing chamber 18 via the oil outlet passage 4*c* and stored there.

The refrigerant gas, after the separation of the oil component therefrom, moves from the oil-separating chamber 19 toward the condenser of the external refrigerating system via the delivery port 4*b* of the delivery service valve 32. Thus, the external refrigerating system can be supplied with the compressed refrigerating gas from which the oil component is removed, and accordingly, the refrigerating performance of the refrigerating system can be surely increased.

The oil component stored in the oil-storing chamber 18 is constantly supplied into the sliding portion of the stationary spiral member 1*b* and the movable end plate 12*c* (see FIG. 2) via the oil supply port 33*a,* the oil supply passage 33*c,* the oil supply port 33*b* and the linear oil-supply passage 1*h* (see FIG. 3). The oil component supplied into the above-mentioned sliding portion is distributed to all portions of the sliding portion of the stationary spiral member 1*b* and the movable end plate 12*c* while the front end of the linear oil supply passage 1*h* is closed by the movable end plate 12*c* of the movable scroll element 12 due to the orbiting motion of the movable scroll element 12 and gravity. When the front end of the linear oil supply passage 1*h* is left open without being closed by the movable end plate 12*c,* the oil component supplied into the sliding portion of the stationary spiral member 1*b* and the movable end plate 12*c* is distributed to the bearing devices 6 and 11, and the self-rotation preventing unit to satisfactorily cool and lubricate both devices 6 and 11 and the self-rotation preventing unit. It should be noted that since the cooling and lubrication of the movable elements and portions, i.e., the sliding portion of the stationary spiral member 1*b* and the movable end plate 12*c,* the bearing devices 6, 11 and the self-rotation preventing unit are achieved by the oil component after being separated from the refrigerant gas, the refrigerant gas per se is not heated by the movable elements and portions. Thus, the scroll type compressor of the first embodiment of the present invention does not bring about a reduction in the compressing performance due to heating of the refrigerant gas.

Further, in the scroll type compressor of the first embodiment, since the suction port 1*f* is directly formed in the intermediate shell portion 1 which is integral with the stationary scroll element 10, the refrigerant gas can be directly sucked into the compression chambers P. Namely, the front housing 2 and the movable end plate 12*c* of the movable scroll element 12 do not need to be machined for forming a suction passage (through-bores or counter bores) to suck the refrigerant gas from the exterior of the compressor into the compression chambers P. Thus, casting dies for producing the front housing 2 and the movable scroll element 12 can be of simple construction having a long operating life. This fact also contributes to elimination of deburring operation to be applied to the cast products. As a result, a reduction in the manufacturing cost of the compressor can be realized.

Figure 8:
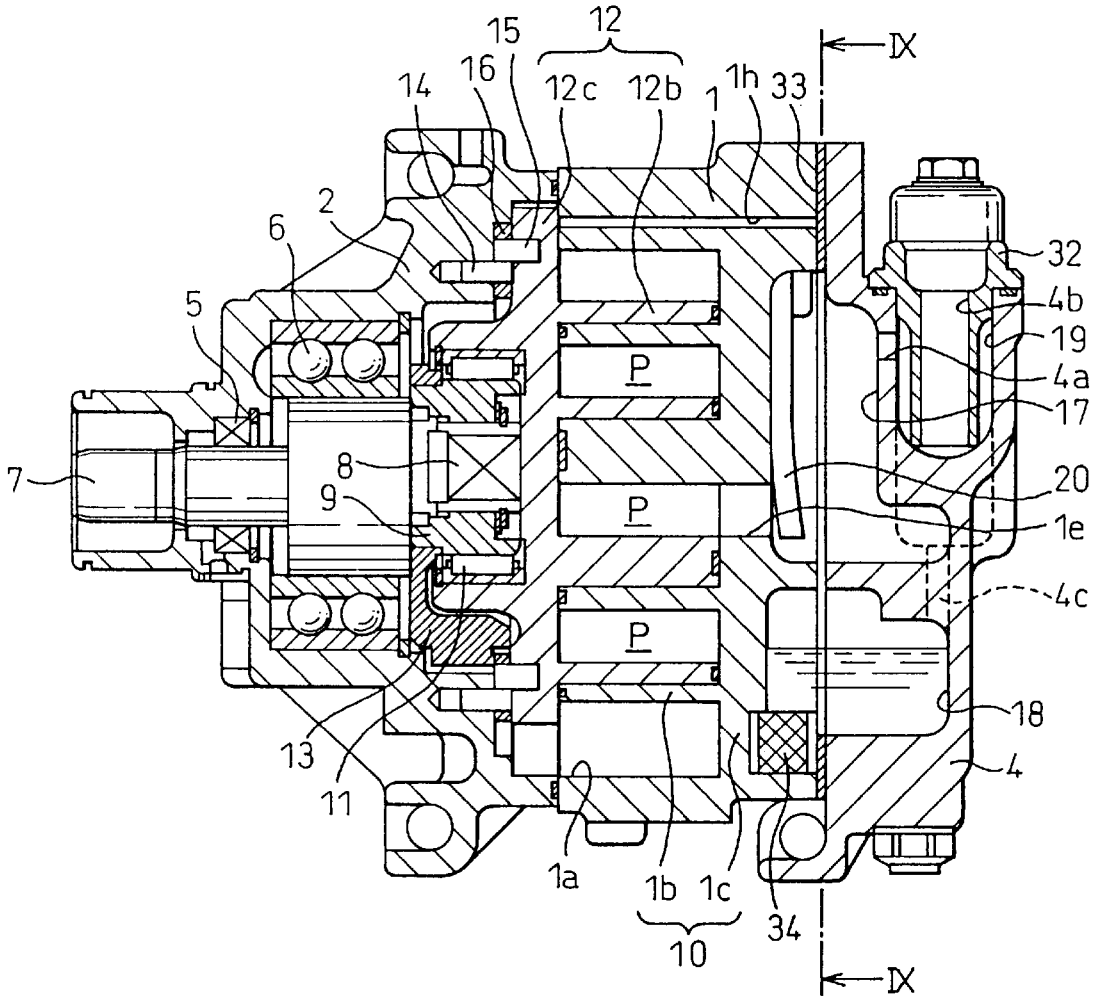
FIG. 8 is a longitudinal cross-sectional view of the scroll type compressor of a second embodiment of the present invention.
Figure 9:
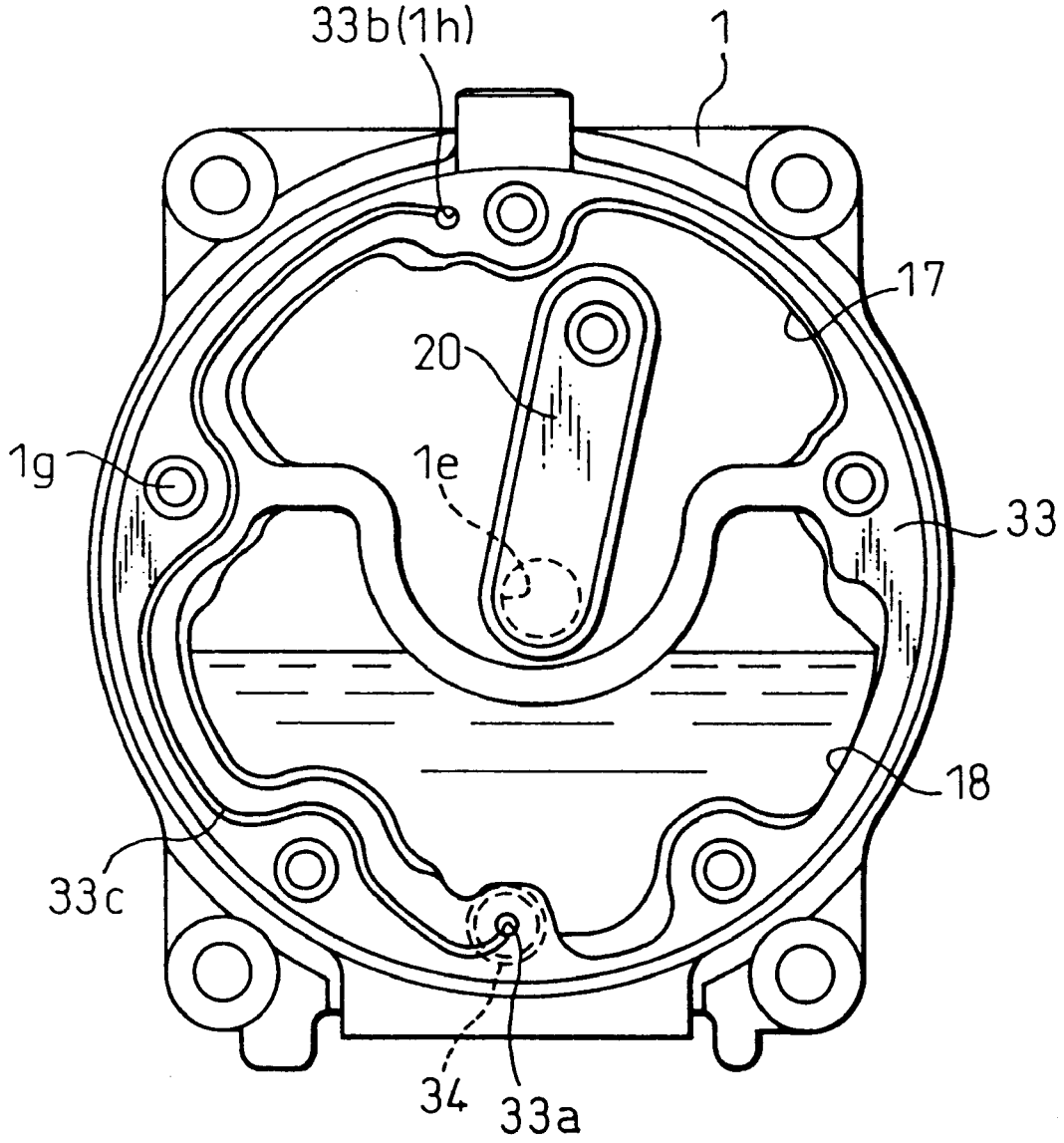
FIG. 9 is an end view taken along the line IX—IX of FIG. 8, illustrating an arrangement of a fluid passage, for an oil component, provided between an outer shell portion and a rear housing, and an arrangement of a filtering element.

FIGS. 8 and 9 illustrate a scroll type compressor according to a second embodiment of the present invention in which an improvement in the processing of oil component, the separation of oil component from refrigerant gas, the storing of the oil component after the separation, and the supply of the oil component after separation into the movable elements and portions of the compressor is achieved.

It should be noted that since the compressing mechanism of the scroll type compressor of the second embodiment is substantially the same as that of the compressor of the first embodiment, the compressing operation performed by the scroll type compressor of the second embodiment can be understood as being basically the same as that performed by the compressor of the first embodiment. Thus, a description of the characterized feature of the scroll type compressor of the second embodiment will be provided below.

The scroll type compressor of the second embodiment is provided with a filtering element 34 in the shape of a hollow cylinder with a meshed wall. The filtering element 34 is provided for removing impurities or a foreign substance such as abraded metallic powder from the oil component stored in the oil-storing chamber 18 before the oil component is supplied into the interior of the front housing 2. Therefore, as best shown in FIG. 8, the filtering element 34 is arranged between a lower portion of the stationary end plate 1*c* of the stationary scroll element 10 and a lower portion of the gasket 33. Further, as clearly shown in FIG. 9, the filtering element 34 is arranged at a position in registration with the oil-supply port 33*a* formed in the lower portion of the gasket 33. Thus, even when a liquid compression occurs at the starting of operation of the scroll type compressor while generating minute metallic abraded powders (the impurities) due to a strong engagement of the stationary and movable scroll elements 10 and 12, the impurities contained in the oil component are removed from the oil component by the filtering element 34, so that the filtered oil component enters the oil-supply port 33*a* and is carried toward the interior of the front housing 2 via the oil-supply passage 33*c,* the upper oil-supply port 33*b,* and the linear oil-supply passage 1*h*. Therefore, the front end and the interior of the oil-supply passage 1*h* are neither closed not plugged by the impurities. Thus, the oil component separated from the refrigerant gas can be constantly and stably supplied into the interior of the front housing 2 and the sliding portion of the stationary spiral member 1*b* and the movable end plate 12*c*. Further, the periphery of the front end of the oil-supply passage 1*h* can be kept clean without any foreign substance attaching thereto, and accordingly, the movable end plate 12*c* of the stationary scroll element 12 can smoothly slide on the front end face of the intermediate shell portion 1 during the orbiting motion thereof. Thus, a smooth and reliable compressing operation can be performed by the cooperation of the stationary and movable scroll elements 10 and 12.

Further, since the filtering element 34 is arranged to be held between the intermediate shell portion 1 and the gasket member 33, the filtering element 34 can be easily assembled into the compressor by inserting it between the shell portion 1 and the gasket member 33 during the assembly of the compressor. Therefore, no substantial increase in the manufacturing cost of the scroll type compressor occurs due to an arrangement of the filtering element 34.

When the meshed wall of the filtering element 34 is clogged by the foreign substance, i.e., the fine metallic abraded powder, during a long operation of the compressor, the oil component might not be supplied from the oil-storing chamber 18 into the oil-supply port 33*a*. Thus, the oil component will not be supplied into the interior of the front housing 2, and the sliding portion of the stationary spiral member 1*b* and the movable end plate 12*c*. Therefore, the bearing devices 6 and 11 and the self-rotation preventing unit might lack lubrication. Nevertheless, when the filtering element 34 is clogged, the oil component stored in the oil-storing chamber 18 overflows into the oil-separating chamber 19 via the oil outlet passage 4*c*, and is carried by the compressed refrigerant gas toward the external refrigerating system. Therefore, the refrigerating gas containing therein the oil component is returned from the refrigerating system to the suction port i*f* of the scroll type compressor. Thus, at least the sliding portion of the stationary and movable scroll elements 10 and 12 can be lubricated by the oil-contained refrigerant gas so as to prevent the compressor from being quickly damaged.

Further, it is possible to periodically replace the filtering element 34 with a different new filtering element 34 by simply disassembling the rear housing 4 and the gasket 33 from the intermediate shell portion 1 in order to prevent an occurrence of the clogging of the filtering element 34.

Figure 10:
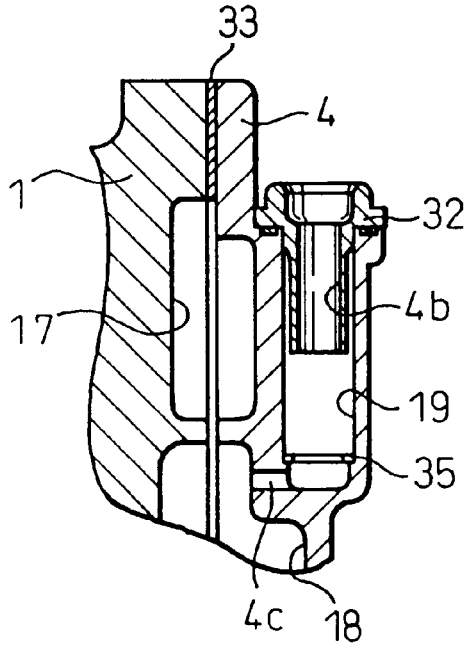
FIG. 10 is a partial enlarged view of a characterized portion of a scroll type compressor according to a third embodiment of the present invention.

Referring to FIG. 10 illustrating a novel feature of a scroll type compressor according to a third embodiment of the present, a plate-like filtering element 35 is disposed in the oil-separating chamber 19 of the rear housing 4. Namely, the plate-like filtering element 35 is arranged in a bottom region in the oil-separating chamber 19, and is positioned above the oil outlet passage 4*c*. The remaining construction of the scroll type compressor of the third embodiment may be understood as being the same as those of the compressors of the first and second embodiments.

In the scroll type compressor of the third embodiment, the filtering element 35 can be assembled into the compressor by simply setting it in the bottom portion of the oil-separating chamber 19 at the position above the oil outlet passage 4*c*. Therefore, an increase in the manufacturing cost of the compressor does not occur due to an arrangement of the filtering element 35. Further, when the plate-like filtering element 35 is clogged by a foreign substance such as a fine metallic abraded powder generated by the sliding of the stationary and movable scroll elements 10 and 12, the oil component separated from the compressed refrigerant gas cannot be sufficiently supplied into the interior of the front housing 2, and the sliding portion of the stationary and movable scroll element 10 and 12 cannot be sufficiently lubricated. Nevertheless, when the clogging of the filtering element 35 occurs, the oil component separated from the refrigerant gas will be retained within the oil-separating chamber 19, and accordingly, the oil component is gradually carried by the compressed refrigerant gas toward the external refrigerating system. Thus, the refrigerant gas containing therein the oil component is returned into the suction port i*f* of the compressor from the external refrigerating system, and lubricates the sliding portion of the stationary and movable scroll elements 10 and 12. Therefore, the compressor is not quickly damaged due to lack of lubrication. Further, as required, the filtering element 35 can be replaced with a new filtering element 35 by removing the filtering element 35 after the disassembling of the delivery service valve 32 from the rear housing 4. Thus, the scroll type compressor of the third embodiment can have a long operating life owing to the constant and stable lubrication of the sliding portion of the stationary and movable scroll elements 10 and 12.

Figure 11:
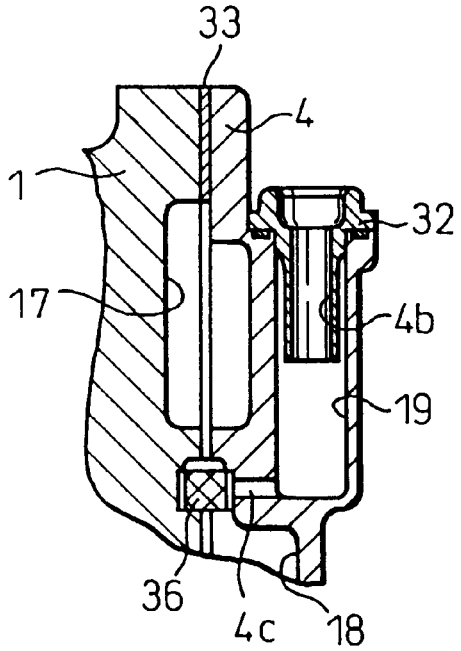
FIG. 11 is a partial enlarged view of a characterized portion of a scroll type compressor according to a fourth embodiment of the present invention.

Referring to FIG. 11 illustrating a novel feature of a scroll type compressor according to a fourth embodiment of the present invention, the compressor is provided with a filtering element 36 for removing impurities from the oil component separated from the refrigerant gas. It should be noted that the remaining construction of the compressor of the fourth embodiment is identical with that of the compressor of the second embodiment shown in FIGS. 8 and 9.

The filtering element 36 has a hollow cylinder with meshed wall, and is held between the stationary end plate 1*c* of the stationary scroll element 10 and the rear housing at a position adjacent to an oil outlet passage 4*c* formed in the wall of the oil-separating chamber 19. Further, the filtering element 36 is arranged at an upper portion of the oil-storing chamber 18. Thus, the filtering element 36 can be easily assembled into the compressor when the intermediate shell portion 1 and the rear housing 4 are assembled together during the manufacturing of the scroll type compressor. Thus, no appreciable increase in the manufacturing cost of the scroll type compressor occurs.

When the filtering element 36 is clogged by the impurities contained in the oil component in the oil-separating chamber 19, and when the oil component is prevented from entering the oil-storing chamber 18 during the operating of the compressor, the oil component will be retained in the oil-separating chamber 19, and gradually carried by the refrigerant gas which is delivered from the delivery port 4*b* toward the external refrigerating system. Thus, the refrigerant gas containing therein the oil component is circulated through the refrigerating system, and accordingly, the sliding portion of the stationary and movable scroll elements 10 and 12 of the compressor can be eventually lubricated by the oil-contained refrigerant gas when the oil-contained refrigerant gas is returned from the refrigerating system into the compressor via the suction port 1*f*. Consequently, the scroll type compressor can be prevented from being quickly damaged due to the lack of lubrication caused by the clogging of the filtering element 36. That is, the scroll type compressor of the present invention can continue its compressing operation even if the compressor runs short of a direct supply of the cooling and lubricating oil component.

FIGS. 12 through 18 illustrate a scroll type compressor of a fifth embodiment of the present invention in which a further improvement in the processing of an oil component, i.e., the separating of an oil component from refrigerant gas, the storing of the oil component after separation, and the supplying of the oil component to the movable elements and portions of the compressor, is achieved.

Figure 12:
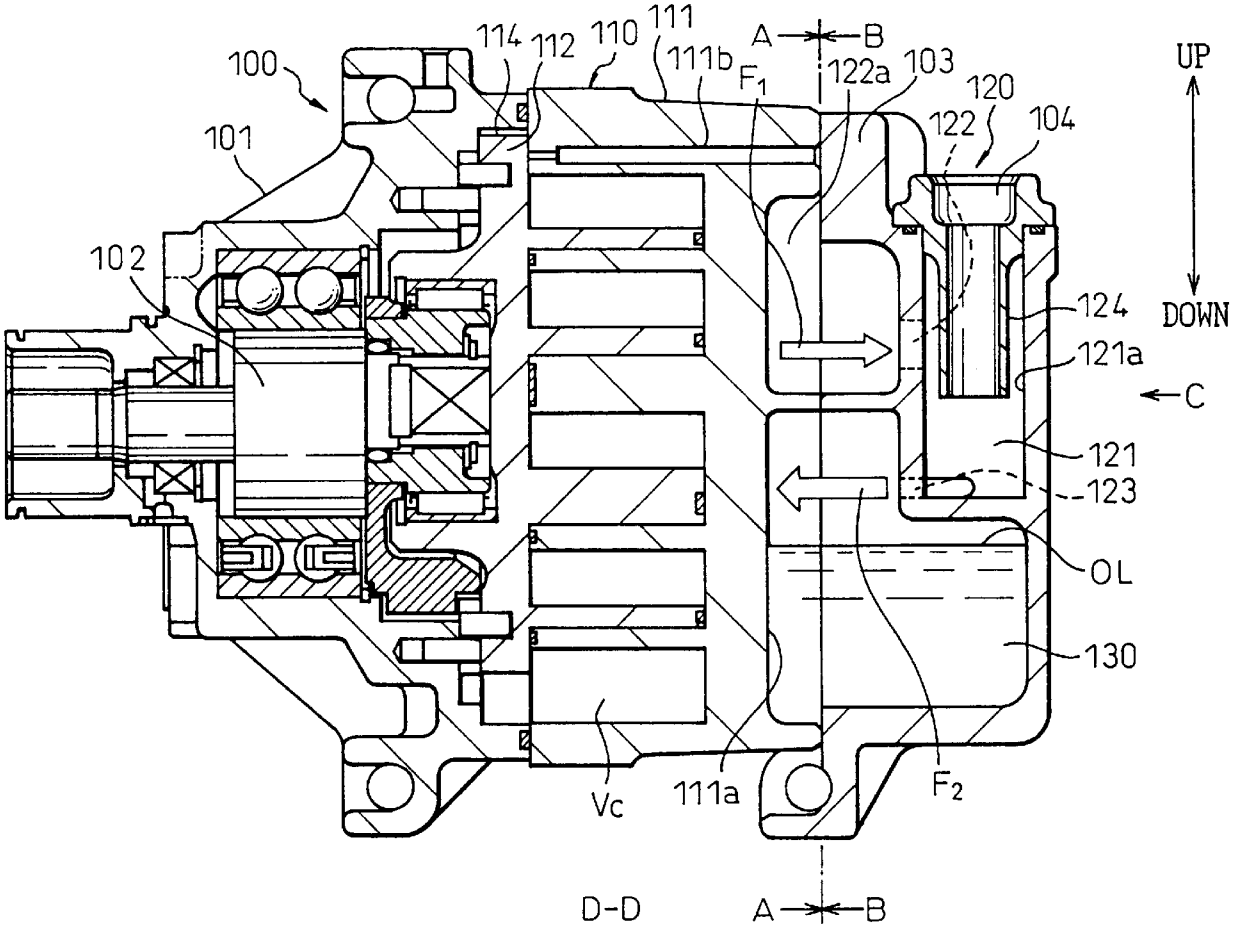
FIG. 12 is a longitudinal cross-sectional view, taken along the line D—D of FIG. 14, of a scroll type compressor according to a fifth embodiment of the present invention.
Figure 13:
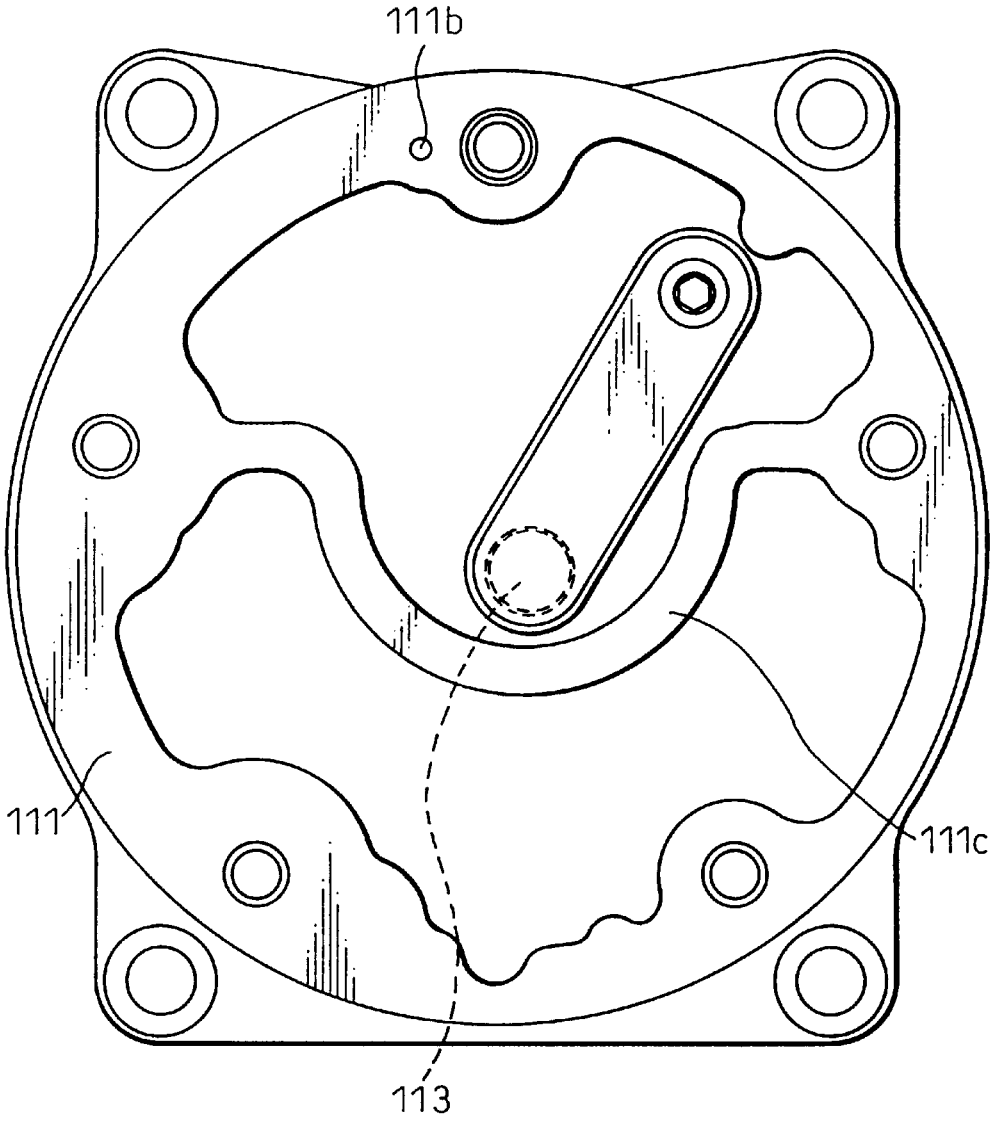
FIG. 13 is a cross-sectional view taken along the line B—B of FIG. 12, illustrating an end face of a stationary scroll element incorporated in the compressor of FIG. 12.

As shown in FIG. 12, a scroll type compressor 100 of the fifth embodiment includes a front housing 101, a refrigerant compressing unit 110 having a stationary scroll element 111 and a movable scroll element 112, and a rear housing 103. The front housing 101 is fixed to a front end of the refrigerant compressing unit 110 via a suitable sealing element, and the rear housing 103 is fixed to a rear end of the refrigerant compressing unit 110 via a suitable gasket (not shown in FIG. 12). The stationary scroll element 111 forms a part of an outer shell of the compressor 100, and is provided with a stationary end plate 111*a* and a spiral member projecting frontward from the stationary end plate 111*a*.

The movable scroll element 112 is movably held between the front housing 101 and the stationary scroll element 111 to implement an orbiting motion with respect to the stationary scroll element 111. The movable element 112 is provided with a movable end plate and a movable spiral member engaged with the stationary spiral member of the stationary scroll element 111.

A drive shaft 102 is rotatably supported by the front housing 101, via a bearing device so as to rotate about its own axis of rotation. Similarly to the scroll compressor of the first embodiment, the rotation of the drive shaft 102 causes the orbiting motion of the movable scroll element 112 with respect to the stationary scroll element 111, via a slide key, a bushing, and anther bearing device which are mounted on an inner end of the drive shaft 102.

As will be understood from FIG. 12, the scroll type compressor of the fifth embodiment is provided with a self-rotation preventing unit similar to that of the first embodiment (FIG. 2). The orbiting motion of the movable scroll element 112 with respect to the stationary scroll element 111 causes shifting of compression chambers Vc defined by both elements 111 and 112 from a spirally outer end where the respective compression chambers Vc introduce refrigerant gas therein toward a spirally inner end where the compression chambers Vc discharge therefrom the refrigerant gas after compression. Namely, the respective compression chambers Vc reduce the volumes thereof during the shifting thereof from the outer end to the inner end so as to compress the introduced refrigerant gas. The scroll type compressor 100 is preferably incorporated in a vehicle refrigerating system, and is driven by a vehicle engine via a pulley mechanism (not shown) incorporating therein a solenoid clutch.

The rear housing 103 attached to the rear end of the stationary scroll element 111 is provided, therein, with a part of a discharge chamber 122*a* which receives the compressed refrigerant gas discharged from the compression chambers Vc via a discharge port 113 (FIG. 13), an oil-separating chamber 121 which functions to separate oil component from the compressed refrigerant gas, and an oil-storing chamber 130 storing therein the separated oil component supplied from the oil-separating chamber 121. The oil-separating chamber 121 is formed as a columnar cavity enclosed by a cylindrical inner wall 121*a* in which an entrance passage 122 for permitting entrance of the refrigerant (the refrigerant gas+the oil component) therein from the discharge chamber 122*a* as shown by an arrow $F_1$ of FIG. 12, and an oil outlet passage 123 permitting delivery of the oil component shown by an arrow $F_2$ from the oil-separating chamber 121 into the oil-storing chamber 130 are formed. Thus, the oil-separating chamber 121 should be arranged above the oil-storing chamber 130 in the rear housing 103.

Figure 14:
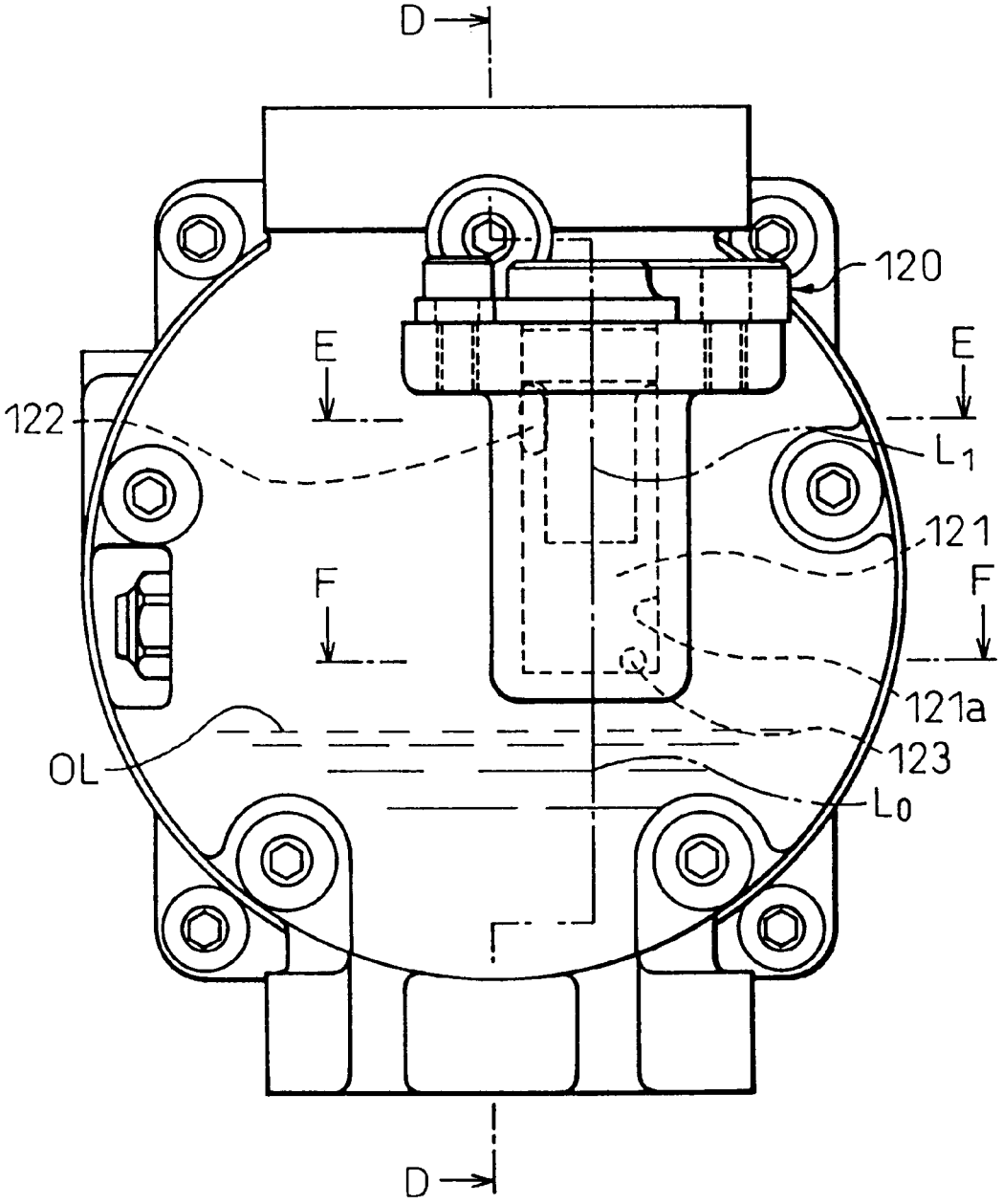
FIG. 14 is a rear view of the compressor of the fifth embodiment viewed from the arrow C of FIG. 12.
Figure 15:
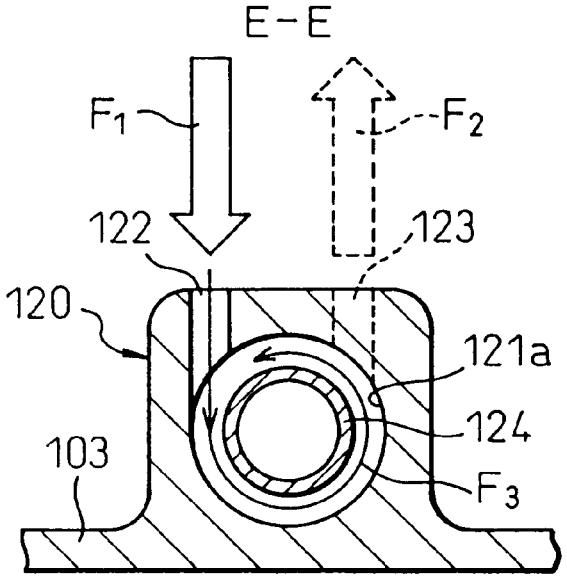
FIG. 15 is a partial cross-sectional view taken along the line E—E of FIG. 14.
Figure 16:
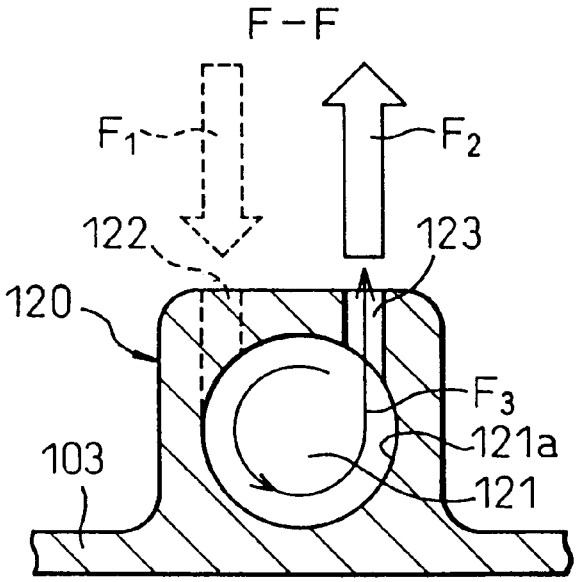
FIG. 16 is a partial cross-sectional view taken along the line F—F of FIG. 14.
Figure 17:
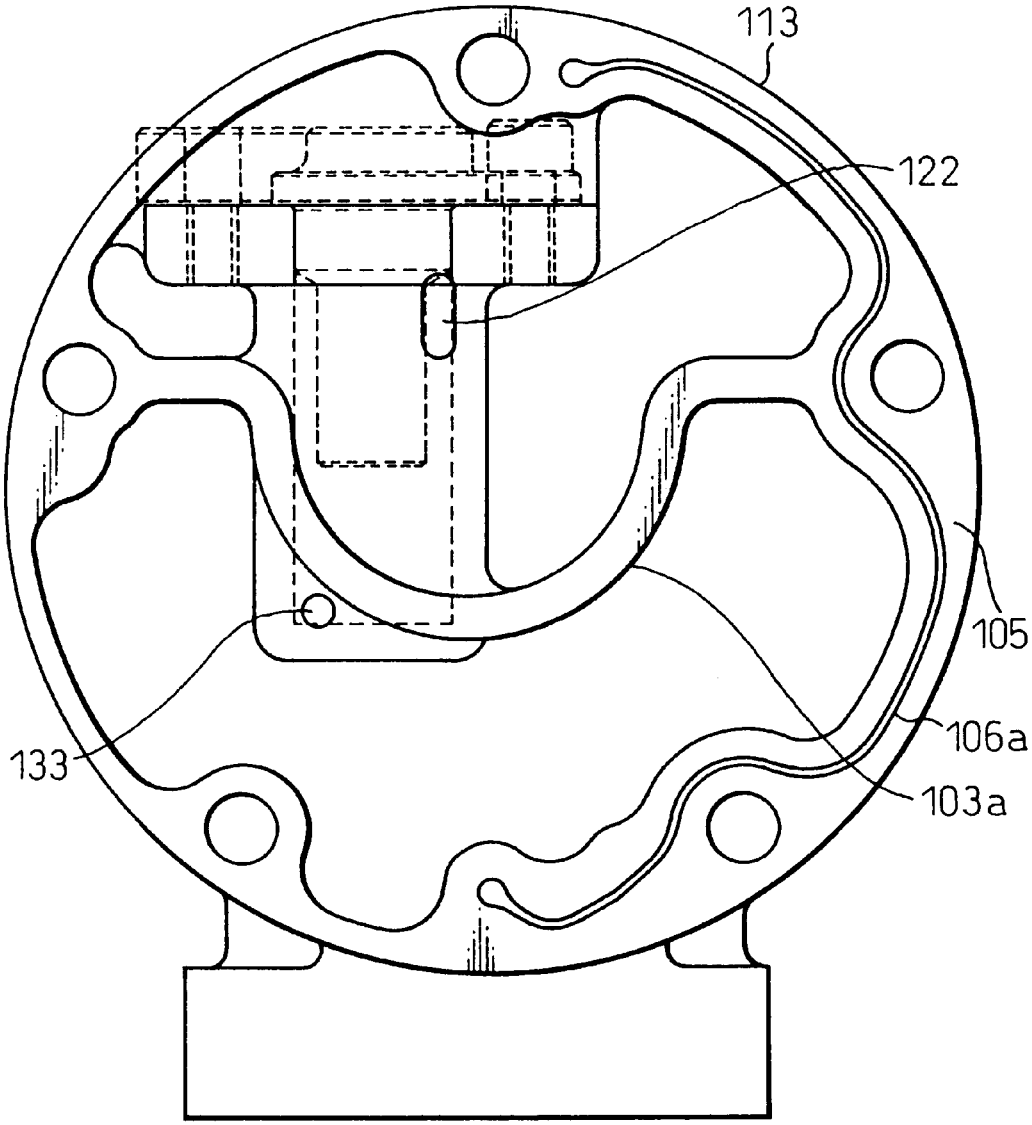
FIG. 17 is an end view of a rear housing, taken along the line A—A of FIG. 12.
Figure 18:
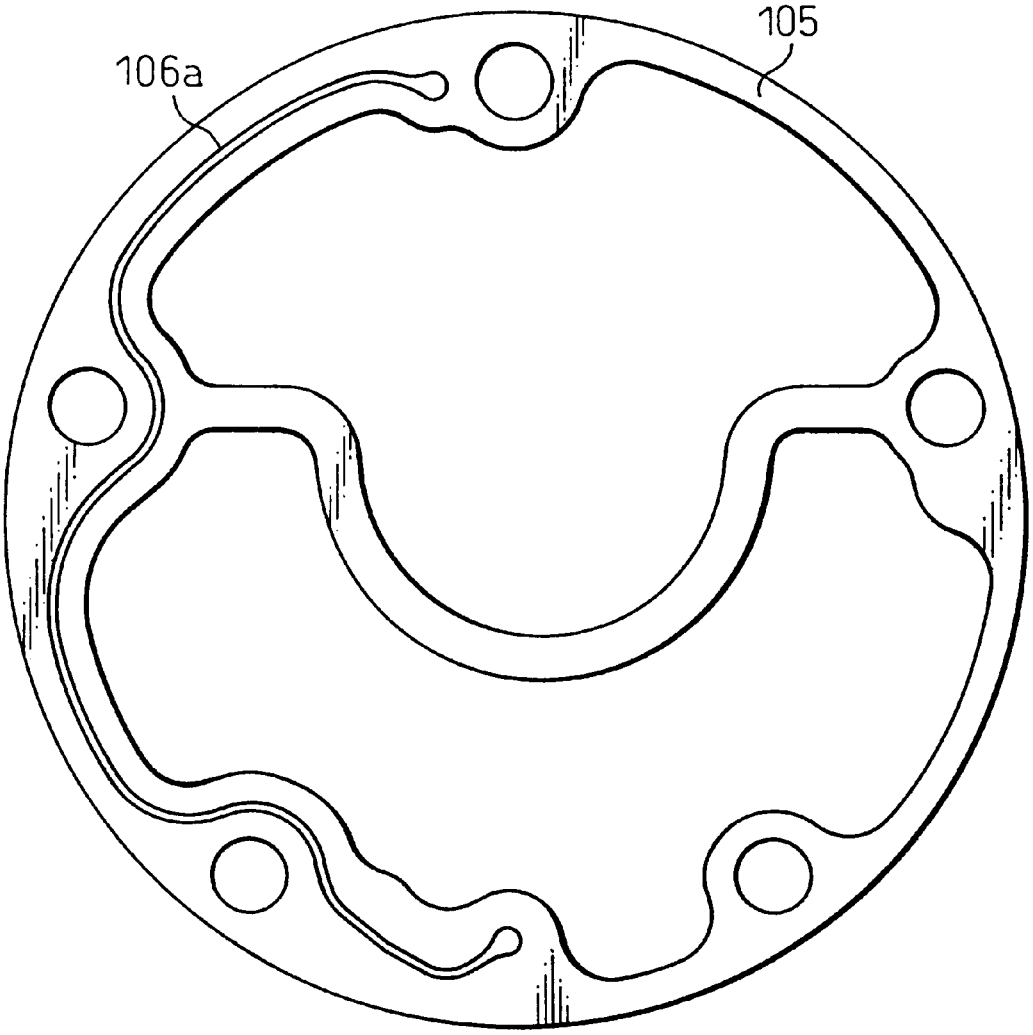
FIG. 18 is an end view of a gasket member incorporated in the compressor of the fifth embodiment.

As shown in FIG. 14, the columnar oil-separating chamber 121 has a longitudinal central axis $L_1$ arranged to be in alignment with a reference line $L_0$ extending perpendicularly to a liquid level "OL" of the oil component stored in the oil-storing chamber 130. The entrance passage 122 is arranged to be positioned above the oil outlet passage 123, and the two entrance and oil outlet passages 122 and 123 are formed to extend tangentially to the cylindrical inner wall 121*a* of the oil-separating chamber 121, and are provided with respective open ends opening toward the stationary end plate 111*a* of the stationary scroll element 111 in an identical direction, as shown in FIGS. 15 and 16. Therefore, the entrance and oil outlet passages 122 and 123 are arranged to lie in separate planes which are parallel with the liquid level "OL" (lying in a horizontal plane) of the oil component stored in the oil-storing chamber 130, respectively.

In use, the scroll compressor of the fifth embodiment is arranged in a condition such that the axis of the drive shaft 102 lies in a horizontal plane parallel with the liquid level "OL" of the oil component within the oil-storing chamber 130.

In FIG. 12, a delivery service valve 124 in the shape of a hollow cylinder is arranged coaxially with the columnar oil-separating chamber 121, and is provided with a delivery port 104 through which the compressed refrigerant gas from which the oil component is removed is delivered toward the vehicle refrigerating system. The cylindrical outer wall of the delivery service valve 124 is effective for causing a circular motion $F_3$ (FIGS. 15 and 16) of the oil-contained refrigerant gas between the outer wall of the delivery service valve 124 and the cylindrical wall 121*a* of the oil-separating chamber 121 by which the oil component is centrifugally separated from the refrigerant gas.

A reference numeral 120 generally indicates an oil-separating unit including the oil-separating chamber 121, the entrance and oil outlet passages 122, 123, and the delivery service valve 124.

The oil component stored in the oil-storing chamber 130 can be supplied into the interior 114 of the front housing 101 via an oil passage 106*a* formed in a gasket 105 (see FIGS. 17 and 18) and a linear oil passage 111*b* formed in the outer shell portion of the stationary scroll element 111. The oil-component supplied into the interior 114 of the front housing 101 is distributed toward the engaging portion of the stationary and movable scroll elements 111 and 112 during the orbiting movement of the movable scroll element 112 to lubricate the engaging portion.

It should be noted that the discharge chamber 122*a* and the oil-storing chamber 130 are separated from one another by a partition wall which is formed by a curved projecting wall 103*a* formed integrally with the rear housing 103 and a projecting wall 111*c* formed integrally with the stationary end plate 111*a* of the stationary scroll element 111.

In accordance with the above-described scroll type compressor of the fifth embodiment, since the oil outlet passage 123 is arranged to be parallel with the liquid level "OL" of the oil component stored in the oil-storing chamber 130, the oil component delivered from the oil-separating chamber 121 as an oil jet collides against an end face of the stationary end plate 111*a* to lose its kinetic energy. Namely, the dynamic pressure of the jetting oil component is controlled. Thus, when the oil component enters the oil-storing chamber 130, it does not directly strike the uppermost surface of the liquid level "OL" of the oil component stored in the oil-storing chamber 130. Therefore, any undulating motion of the surface of the oil component can be prevented from occurring within the oil-storing chamber 130, and accordingly, there occurs no reverse flow of the oil component from the oil-storing chamber 130 into the oil-separating chamber 121. Accordingly, the oil component in the oil-storing chamber 130 can be stably and constantly supplied into the interior of the front housing 101 so as to lubricate the engaging portion of the stationary and movable scroll elements 111 and 112.

It will be understood from the above-description that the oil-processing unit provided inside the scroll type compressor 100 according to the present invention can prevent the upper surface of the liquid level "OL" of the oil component in the oil-storing chamber 130 from being undulated without using a method of increasing the capacity of the oil-storing chamber 130. Accordingly, an effective separation of the oil component from the refrigerant gas can be surely achieved without an increase in the volume of the compressor.

Further, as shown in FIGS. 15 and 16, the entrance passage 122 and the oil outlet passage 123 are juxtaposed and in parallel with one another. Therefore, the two passages 122 and 123 can be bored by machining without resetting the position of the rear housing 103 on the chuck of a machine tool. Therefore, the machining of the entrance and oil outlet passages 122 and 123 can be simple to reduce the manufacturing cost of the rear housing 103 and in turn that of the scroll type compressor.

Further, in the scroll type compressor 100, the partition wall between the discharge chamber 122*a* and the oil-storing chamber 130 are simply formed by the projecting walls 103*a* and 111*a* of the rear housing 103 and the stationary scroll element 111 which are axially mated together when the rear housing 103 is fixed to the stationary scroll element 111 via the gasket 105. Thus, separation of the two different chambers can be easily obtained.

The delivery service valve 124 which is coaxially arranged in the columnar oil-separating chamber 121 can function not only as a delivery passage to deliver the compressed refrigerant gas but also as an oil separator effective for centrifugally separating the oil component from the refrigerant gas. Thus, the compressing performance of the scroll compressor can be improved over the conventional scroll type compressor without an increase in the manufacturing cost of the scroll type compressor 100.

In the oil-separating chamber 121 of the scroll type compressor 100, as the entrance passage 122 is arranged to be tangential to the cylindrical inner wall 121*a* of the chamber 121, the oil-contained refrigerant gas entering the oil-separating chamber 121 through the entrance passage 122 circulates within the chamber 121 along the cylindrical inner wall 121*a*. Therefore, the oil component is effectively separated from the refrigerant gas by centrifugal force, and the separated oil can be smoothly delivered into the oil-storing chamber 130 by inertia through the oil outlet passage 123 which is also arranged to be tangential to the cylindrical inner wall 121*a* of the oil-separating chamber 121. Thus, the oil-storing chamber 130 can surely receive and store the oil component, and is able to stably supply it into the interior of the front housing 101.

Figure 19:
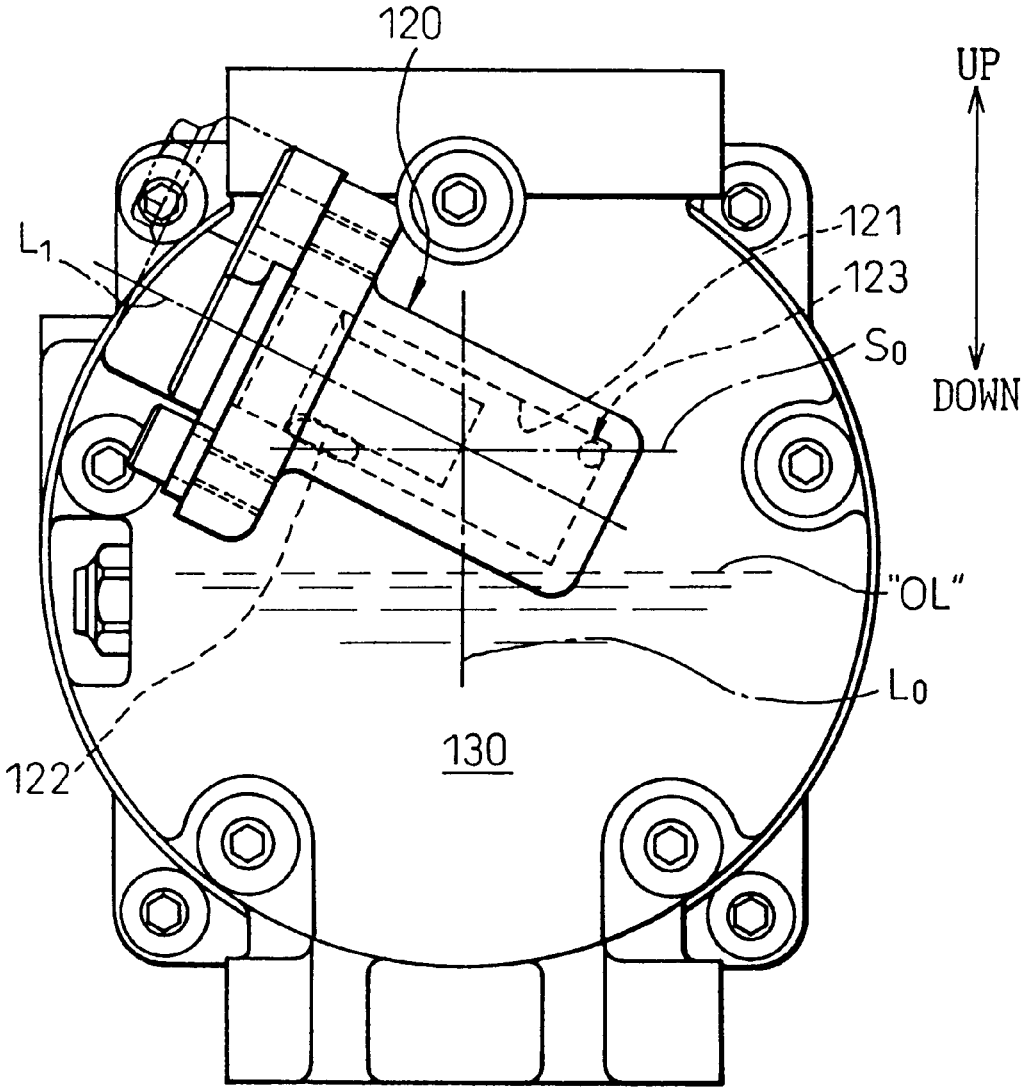
FIG. 19 is a rear view of a scroll type compressor according to a sixth embodiment of the present invention, similar to the view of FIG. 14.

Referring to FIG. 19, a scroll type compressor according to a sixth embodiment of the present invention is different from the scroll type compressor of the previous embodiment in that an oil-separating unit 120 is provided with an oil-separating chamber 121 having a central axis $L_1$ thereof which is inclined from the reference axis $L_0$ which is vertical to the upper surface of the liquid level "OL" of oil component stored in an oil-storing chamber 130. However, as will be clearly understood from FIG. 19, an entrance passage 122 of the present embodiment formed in the cylindrical wall of the oil-separating chamber 121 should be arranged to lie in a plane located above a plane "S0" in which an oil outlet passage 123 lies.

When the central axis $L_1$ of the oil-separating chamber 121 is inclined, it is possible to maintain the highest upper surface of the oil level "OL" at a level higher in the case of the previous embodiment, in which the central axis $L_1$ of the oil-separating chamber 121 is in alignment with the vertical reference axis $L_0$, without an increase in the capacity of the oil-storing chamber 130. Accordingly, the scroll type compressor of the present sixth embodiment can constantly store an increased amount of the oil component in the oil-storing chamber 130 without an increase in the entire size of the compressor per se. Thus, the oil separating unit 120 can have a larger oil separating performance compared with the oil-separating unit 120 of the previous embodiment.

Figure 20:
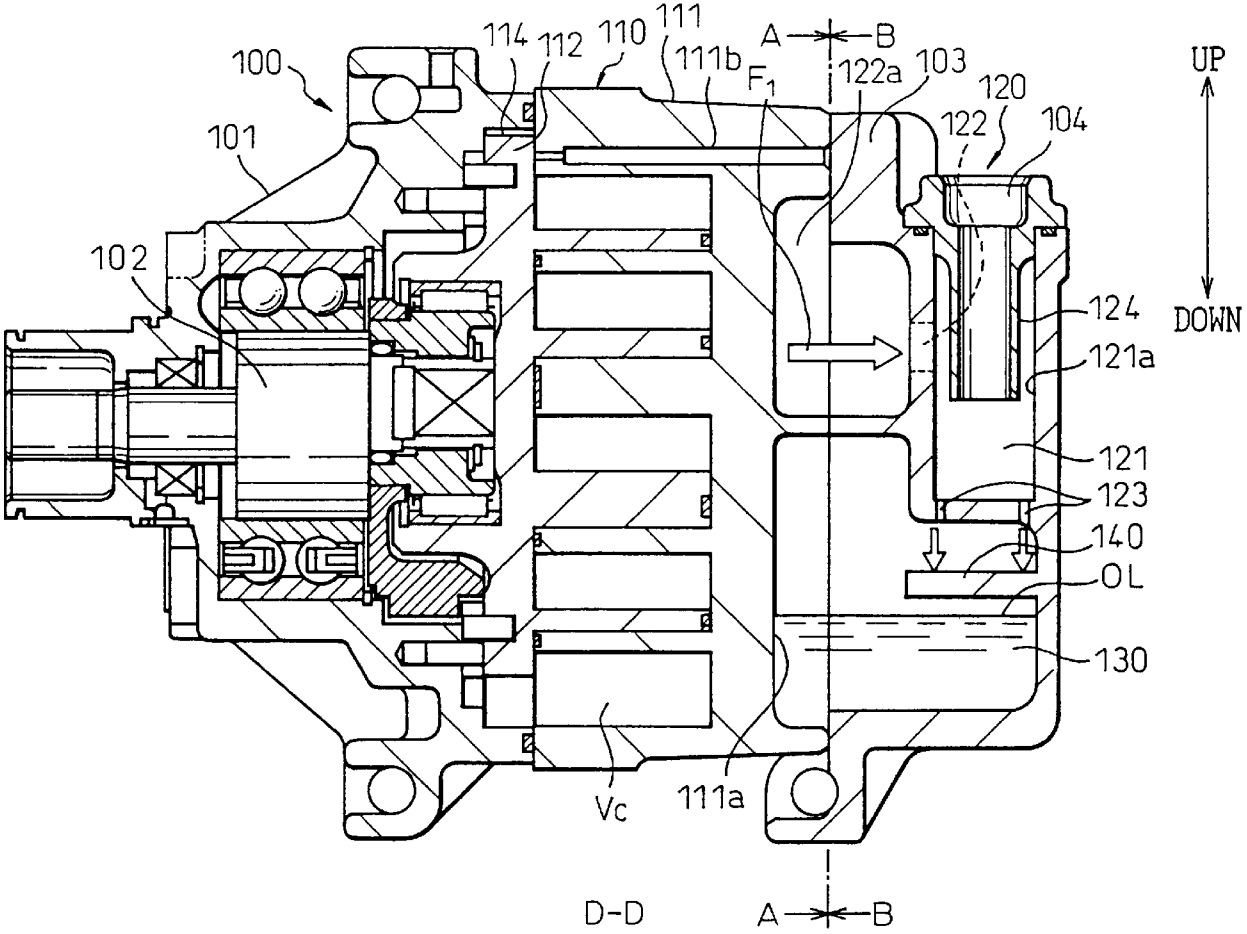
FIG. 20 is a longitudinal cross-sectional view of a scroll type compressor according to a seventh embodiment of the present invention.

FIG. 20 illustrates a scroll type compressor according to a seventh embodiment of the present invention. This scroll type compressor is characterized in that when oil component is delivered from an oil-separating chamber 121 as an oil jet through an oil outlet passage 123 formed in a bottom wall of the oil-separating chamber 130, it collides against a buffer plate 140 projecting from an inner wall of a rear housing 103 into the oil-storing chamber 130. Since the buffer plate 140 is arranged in parallel with the oil level "OL" of the oil component stored in the oil-storing chamber 130, the oil jet collides vertically against the buffer plate 140, and is prevented from directly striking the upper surface of the oil component in the oil-storing chamber 130. Thus, the surface of the oil component in the oil-separating chamber 130 is prevented from being undulated. Thus, the oil component can be stably stored in the oil-storing chamber 130, and accordingly, be constantly supplied into the interior of a front housing 101 via oil passages in the same manner as in the fifth embodiment of FIGS. 12 through 18.

Figure 21:
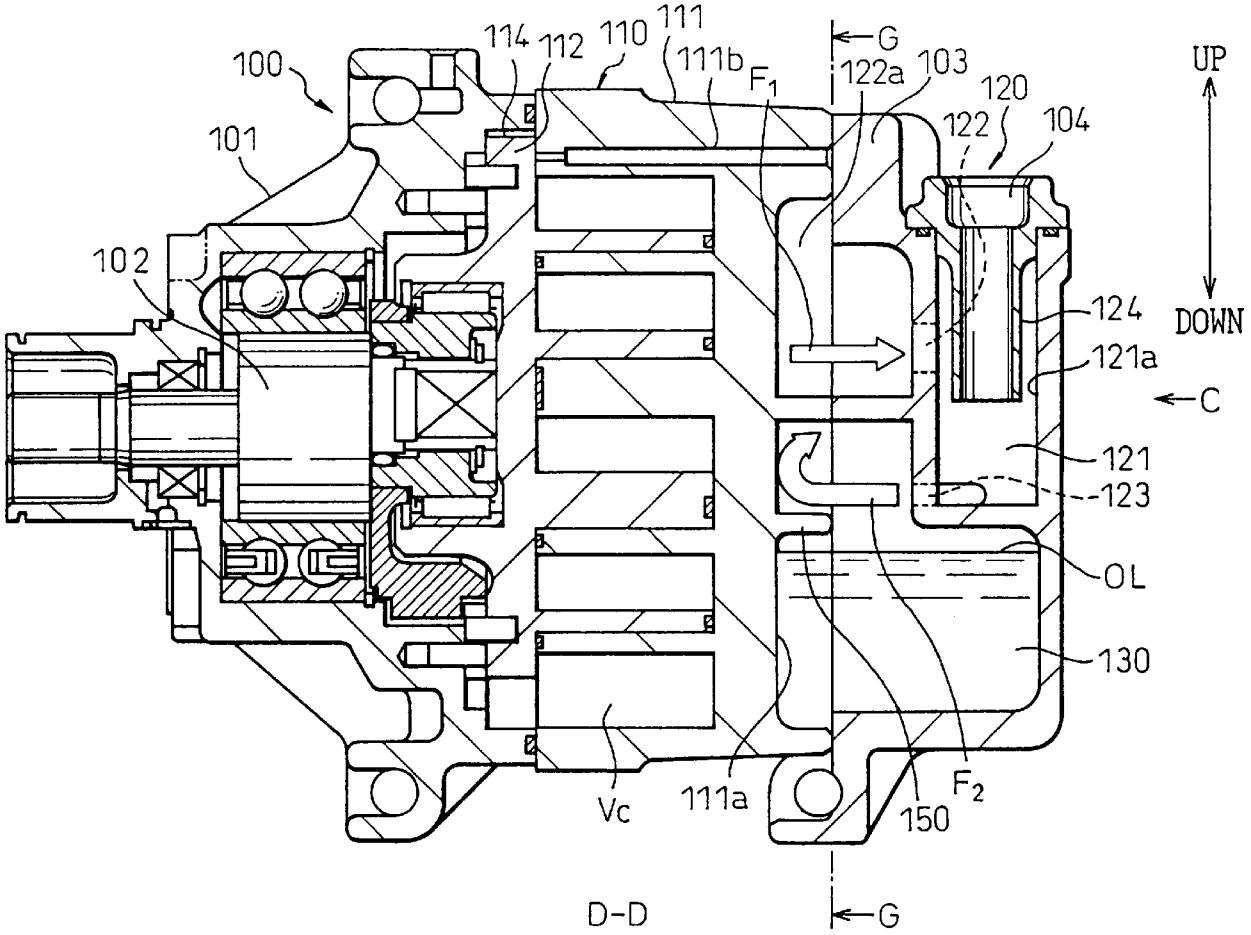
FIG. 21 is a longitudinal cross-sectional view, corresponding to the view of FIG. 12, of a scroll type compressor according to an eighth embodiment of the present invention.
Figure 22:
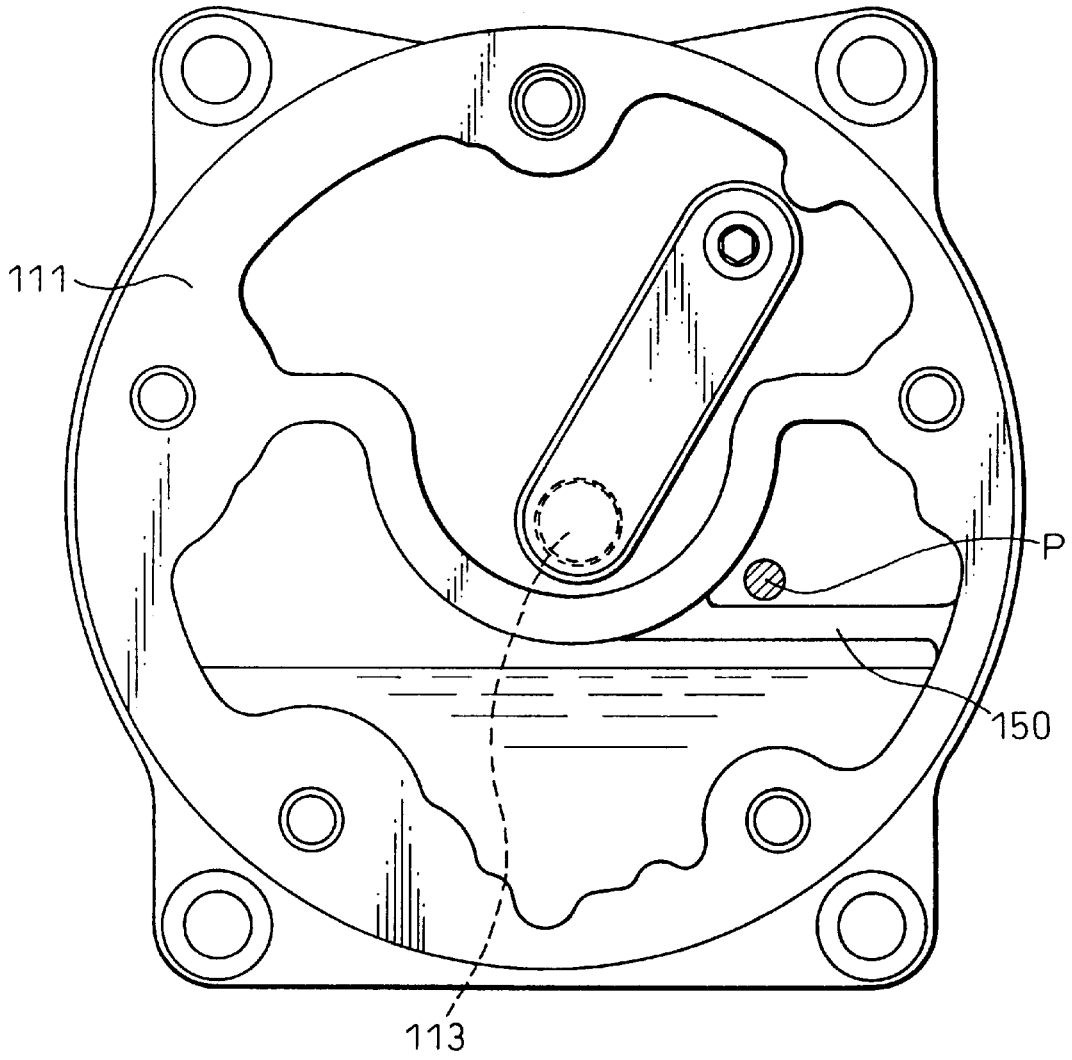
FIG. 22 is an end view, taken along the line G—G, of a stationary scroll element incorporated in the compressor of FIG. 21.

FIGS. 21 and 22 illustrate a scroll type compressor according to an eighth embodiment of the present invention. The scroll type compressor of the present embodiment is characterized in that a blocking plate 150 is provided to direct an oil jet delivered from an oil-separating chamber 121 toward a partition wall between a discharge chamber and an oil-separating chamber 130 after colliding against an end face of a stationary end plate 111*a* of a stationary scroll element 111 (see an arrow in FIG. 21). Namely, the oil jet delivered from the oil-separating chamber 121 is prevented from directly flowing into the oil-storing chamber 130 after colliding against the end face of a stationary end plate 111*a*. Therefore, the upper surface of the oil component in the oil-storing chamber 130 can be prevented from being undulated by the oil jet delivered from the oil-separating chamber 121. As will be understood from FIG. 22, the blocking plate 150 is formed as rib-like wall plate integral with the stationary end plate 111*a*, and the oil jet horizontally delivered from the oil-separating chamber 121 collides against the end face of the stationary end plate 111*a*, at a point "P", as shown in FIG. 22.

Figure 23:
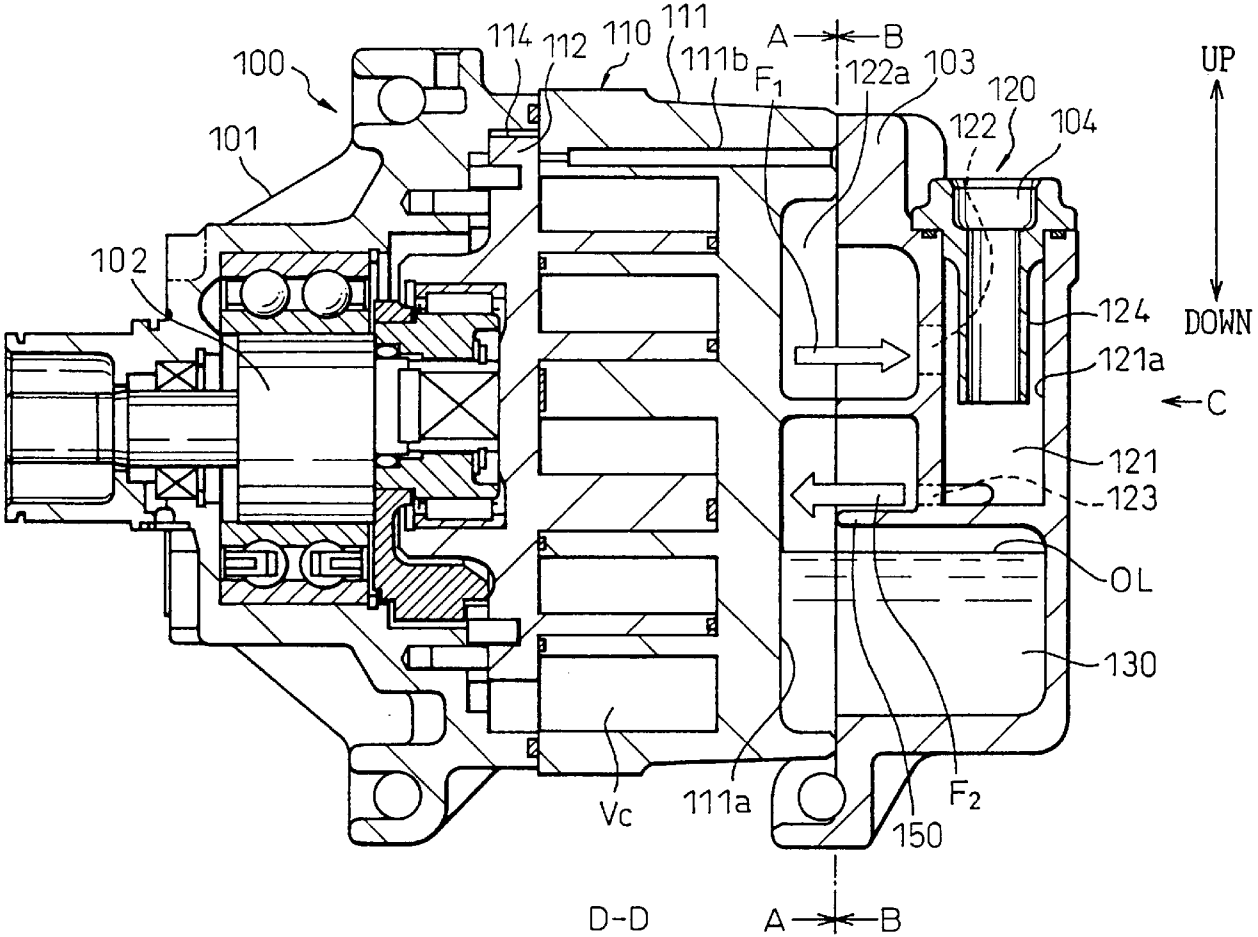
FIG. 23 is a longitudinal cross-sectional view, corresponding to the view of FIG. 12, of a scroll type compressor modified from the compressor of FIG. 12; and, FIG. 24 is a partial cross-sectional view, corresponding to FIG. 15, of a compressor modified from the compressor of FIG. 21.
Figure 24:
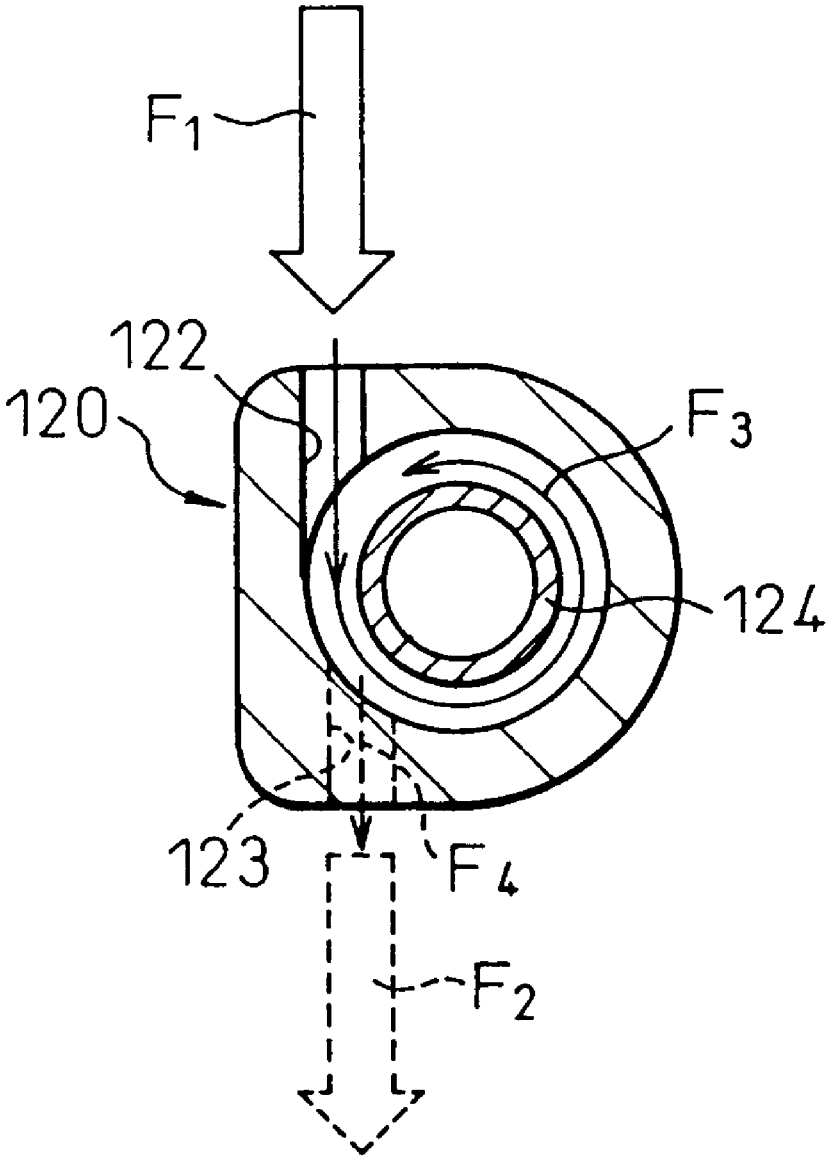

FIG. 23 illustrates a modification of the scroll type compressor of FIGS. 21 and 22, in which a blocking plate 150 is formed integrally with a part of the rear housing 103. The blocking plate 150 of the scroll type compressor of FIG. 23 can prevent an oil jet $F_2$ spouting through an oil outlet passage 123 of the oil-separating chamber 121 from directly beating the upper surface "OL" of the oil component stored in the oil-storing chamber 130. The oil outlet passage 123 of the oil-separating chamber 121 arranged to be parallel with an entrance passage 122 through which the oil-contained refrigerant gas enters from the discharge chamber 122*a* into the oil-separating chamber 121 may be modified so as to be arranged in alignment with the entrance passage 122 as shown in FIG. 24.

From the foregoing description of the preferred embodiments of the present invention, it will be understood that the scroll type compressor can exhibit a high and reliable compressing performance over a long operation life without an increase in manufacturing cost.

Many and various modifications and changes may occur to persons skilled in the art without departing from the spirit and scope of the present invention claimed in the accompanying claims.

We claim:

1. A scroll type compressor comprising:

a housing assembly including a front housing, an intermediate outer shell portion, and a rear housing;

a stationary scroll element having a stationary end plate fixedly held by said housing assembly and a stationary spiral member integral with said stationary end plate;

a movable scroll element movably supported in said housing assembly by a bearing device held by said front housing and having a movable end plate, and a movable spiral member integral with said movable end plate, said movable scroll element being arranged to be engaged with said stationary scroll element to form, between both elements, compression chambers for compressing a refrigerant gas, said compression chambers being spirally shifted to reduce the volumes thereof, in response to an orbiting motion of said movable scroll element with respect to said stationary scroll element, the compressed refrigerant being delivered from said compression chambers to an external refrigerating system via a discharge chamber formed in said rear housing;

a drive shaft arranged to be rotatable about an axis of rotation thereof within said front housing of said housing assembly and to actuate the orbiting motion of said movable scroll element with respect to said stationary scroll element, wherein said stationary end plate and said spiral member of said stationary scroll element are formed integrally with said intermediate outer shell portion of said housing assembly, said stationary scroll element defining a spiral groove formed in said intermediate outer shell portion to spirally extend from an outer end thereof toward an inner end thereof, said shell portion having a suction port formed therein to communicate with said outer end of said spiral groove to thereby permit the refrigerant gas to be introduced into each of said compression chambers before each of said compression chambers is spirally shifted, and wherein said rear housing is provided with an oil-separating chamber for separating an oil component contained in the compressed refrigerant gas therefrom when the compressed gas enters from said discharge chamber into said oil-separating chamber via an entrance passage, and an oil-storing chamber fluidly communicating with said oil-separating chamber, and receiving the separated oil component to store, said oil-storing chamber communicating with an interior of said front housing via a fluid passage formed in said housing assembly; and, a filtering element for removing impurities contained in the oil component before the oil component is supplied into said interior of said front housing from said oil-storing chamber, wherein said oil-separating chamber and said oil-storing chamber are fluidly connected by an oil outlet passage formed in said rear housing, said filtering element being arranged in said oil outlet passage, and said oil outlet passage arranged between said oil-separating chamber and said oil-storing chamber is formed to have a central axis thereof along which the oil component flows from said oil-separating chamber into said oil-storing chamber, said central axis of said oil outlet extending in parallel with an upper level of the oil component stored within said oil-storing chamber, wherein said oil-separating chamber is defined by a substantially columnar inner wall to have a substantially cylindrical cavity therein, said entrance passage between said discharge chamber and said oil-separating chamber having a central axis thereof extending tangentially with said columnar inner wall of said oil-separating chamber, and said central axis of said oil outlet passage extending tangentially with said columnar inner wall of said oil-separating chamber.

2. The scroll type compressor according to claim 1, wherein said stationary end plate of said intermediate outer shell portion is provided with a recess formed therein to form a part of said oil-storing chamber formed in said rear housing, said recess of said stationary end plate communicating with said oil-storing chamber formed in said rear housing via an opening formed in a gasket element interposed between said intermediate outer shell portion and said rear housing.

3. The scroll type compressor according to claim 2, wherein said fluid passage includes at least a linear passage extending through said intermediate outer shell portion and having open ends formed in front and rear opposite ends of said intermediate outer shell portion, and a curved passage recessed in said gasket element to provide a fluid communication between said oil-storing chamber and said linear passage.

4. The scroll type compressor according to claim 1, wherein said suction port of said intermediate outer shell portion is arranged at a position adjacent to the outer end of the spiral groove of the stationary scroll element to permit the refrigerant gas to be directly introduced into the compression chambers.

5. The scroll type compressor according to claim 4, wherein said suction port comprises a through-hole bored in said intermediate outer shell portion and enclosed in a cylindrical wall having a predetermined diameter.

6. The scroll type compressor according to claim 1, wherein said filtering element is held by at least two of said intermediate outer shell portion, said rear housing, and a gasket element arranged between said stationary scroll element integral with said intermediate outer shell portion and said rear housing.

7. The scroll type compressor according to claim 6, wherein said filtering element is arranged between said oil-storing chamber and said fluid passage, so that the impurities are removed from the oil component by said filtering element before the oil component enters said fluid passage.

8. The scroll type compressor according to claim 6, wherein said filtering element is arranged between said oil-separating chamber and said oil-storing chamber, so that the impurities are removed from the oil component by said filtering element before the oil component flows from said oil-separating chamber into said oil-storing chamber.

9. The scroll type compressor according to claim 1, wherein said entrance passage lies in a plane corresponding to or located above a reference plane extending in parallel with the upper level of the oil component and permitting said oil outlet passage to lie therein.

10. The scroll type compressor according to claim 1, wherein said oil-separating chamber in the shape of a columnar cavity has a central axis $L_1$ thereof which is inclined with respect to a reference line $L_0$ vertical to the upper level of the oil component within said oil-storing chamber.

11. The scroll type compressor according to claim 1, wherein said entrance passage and said oil outlet passage are arranged to be in juxtaposition and in parallel with one another.

12. The scroll type compressor according to claim 1, wherein said scroll type compressor is arranged so that the axis of rotation of said drive shaft extends in parallel with the upper level of the oil component stored in said oil-storing chamber.

13. The scroll type compressor according to claim 1, wherein said oil-separating chamber and said oil-storing chamber are fluidly connected by an oil outlet passage formed in said rear housing, and wherein a buffer wall member is arranged for preventing the oil component discharging from said oil-separating chamber toward said oil-storing chamber through said oil outlet passage from directly colliding against the upper level of the oil component stored in said oil-storing chamber.

14. The scroll type compressor according to claim 13, wherein said buffer wall member is formed to be integral with said rear housing.

15. The scroll type compressor according to claim 13, wherein said buffer wall member is formed to be integral with said stationary end plate of said intermediate outer shell portion.

* * * * *